US010803708B2

(12) United States Patent
Nakamura

(10) Patent No.: US 10,803,708 B2
(45) Date of Patent: Oct. 13, 2020

(54) GAMING MACHINE, METHOD AND PROGRAM FOR PROVIDING A GAME

(71) Applicant: Konami Gaming, Inc., Las Vegas, NV (US)

(72) Inventor: Daisuke Nakamura, Zama (JP)

(73) Assignee: Konami Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/991,978

(22) Filed: May 29, 2018

(65) Prior Publication Data

US 2018/0276955 A1 Sep. 27, 2018

Related U.S. Application Data

(63) Continuation of application No. 14/824,947, filed on Aug. 12, 2015, now Pat. No. 10,013,855.

(30) Foreign Application Priority Data

Aug. 13, 2014 (JP) ..... 2014-164781

(51) Int. Cl.
*G07F 17/34* (2006.01)
*G07F 17/32* (2006.01)

(52) U.S. Cl.
CPC ..... *G07F 17/34* (2013.01); *G07F 17/3267* (2013.01)

(58) Field of Classification Search
CPC ..... G07F 17/3211
See application file for complete search history.

(56) References Cited

U.S. PATENT DOCUMENTS 5,395,111 A * 3/1995 Inoue ..... G07F 17/3213 273/143 R
8,574,059 B2 11/2013 Rodgers et al.
8,784,206 B1 7/2014 Gronkowski et al.
2004/0023714 A1 2/2004 Asdale
2005/0059478 A1* 3/2005 Peterson ..... G07F 17/3211 463/20
2006/0084492 A1* 4/2006 Baerlocher ..... G07F 17/3213 463/20
2006/0084498 A1* 4/2006 Baerlocher ..... G07F 17/3213 463/20
2011/0190044 A1 8/2011 Berman et al.
2014/0066172 A1 3/2014 Nakamura et al.

OTHER PUBLICATIONS

Patent Examination Report No. 1 (AU Patent Application No. 2015213264); dated Oct. 27, 2015.

* cited by examiner

*Primary Examiner* — Reginald A Renwick
(74) *Attorney, Agent, or Firm* — Howard & Howard Attorneys PLLC

(57) ABSTRACT

To provide a gaming machine, method and program for providing a game that can achieve a game progression more rich in variation than a conventional gaming machine and provide a player with more entertainment value. Providing, on a reel of the gaming machine 1, a static symbol region that statically displays a symbol selected from a first symbol set, and a dynamic symbol region that, after displaying while varying symbols included in a second symbol set, stops the variation and indicates a predetermined symbol.

24 Claims, 18 Drawing Sheets

| | | | | |
|---|---|---|---|---|
| PIC-a | Wild | PIC-a | Wild | PIC-a |
| PIC-a | Wild | PIC-a | Wild | PIC-a |
| PIC-a | J | PIC-a | Wild | A |

GAMING MACHINE, METHOD AND PROGRAM FOR PROVIDING A GAME

CROSS-REFERENCE TO RELATED APPLICATION

This application is a continuation of U.S. patent application Ser. No. 14/824,947, filed Aug. 12, 2015, which claims priority to Japanese Patent Application No. 2014-164781, filed Aug. 13, 2014, the disclosure of which is hereby incorporated by reference in its entirety.

TECHNICAL FIELD

The present invention relates to a gaming machine, a method and program for providing a game.

BACKGROUND ART

A gaming machine represented by a slot machine is highly popular among casino customers as a device that provides gambling that is easy to enjoy, and recent statistics also report, in part, that sales from gaming machines account for the majority of casino earnings. Initial slot machines were simple devices, wherein an inserted coin is received, a configured reel rotates and stops mechanically according to a handle operation, and win or lose is determined by a combination of symbols stopped on a single pay line. However, recent gaming machines, such as mechanical slot machines driven by a highly accurate physical reel via a computer controlled stepping motor, video slot machines that display a virtual reel on a display connected to a computer, and various gaming machines that apply similar technology to other casino games are quickly advancing. For the manufacturers that develop these gaming machines, an important theme is to provide an attractive game that strongly attracts casino customers as players, and improves the functionality of the gaming machine.

DOCUMENTS OF THE RELATED ART

Patent Document #1: U.S. Pat. No. 8,574,059.

SUMMARY OF INVENTION

Problem to be Solved by the Invention

In gaming machines like those described above, symbols displayed in a matrix shape having a plurality of rows and a plurality of columns, and a winning determination performed for a plurality of set combinations where the symbols stop on a pay line is known. For this type of gaming machine, the display of symbols in each column on one reel using a number of columns and the same number of reels is known. Further, gaming machines are known wherein a plurality of small reels (independent reels) are arranged in the matrix shape, each reel being separate, and one symbol is varied and displayed by rotating and stopping. In the above Patent Document 1, a game machine having an independent reel is disclosed. However, in the present technical field, the achievement of progress for games having even more variation than these conventional gaming machines, and gaming machines capable of providing even higher entertainment value to players are pursued.

Various aspects of the present invention have been made in light of the above circumstances, and an object is to achieve progress for games having even more variation than conventional gaming machines, and to provide a gaming machine, a game providing method, and a program capable of providing even higher entertainment value to players.

Means for Solving the Problem

A gaming machine according to one aspect of the present invention including an operation unit that accepts operation by a player; a display unit where a plurality of reels having symbols is displayed; and a control unit connected to the operation unit and the display unit and that rotates and stops the plurality of reels according to the operation of the operation unit by a player, pays a payout for a combination of symbols formed on the display unit according to the plurality of stopped reels; wherein at least one of the plurality of reels has a static symbol region that statically displays a symbol selected from a first symbol set, and a dynamic symbol region that, after displaying while varying the symbols included in a second symbol set, stops the variation and indicates a predetermined symbol; and the control unit varies the symbol displayed on the display unit by a combination of a process that rotates the plurality of reels and a process the varies the type of symbol in the dynamic symbol region.

Further, a method for providing a game according to one aspect of the present invention is a method for providing a game by a gaming machine comprising an operation unit that accepts operation by a player, a display unit where a plurality of reels having symbols is displayed, and a control unit connected to the operation unit and the display unit, wherein at least one of the plurality of reels has a static symbol region that statically displays a symbol selected from a first symbol set, and a dynamic symbol region that, after displaying while varying symbols included in a second symbol set, stops the variation and indicates a predetermined symbol; wherein the control unit executes a step, in accordance with the operation unit accepting an operation by a player, for the control unit to vary the symbols displayed on the display unit by a combination of a process that rotates the plurality of reels and a process the varies the type of symbols in the dynamic symbol region; a step for stopping a symbol displayed on the display unit by a combination of a process that rotates and stops the plurality of reels and a process that stops the variation of the type of symbol displayed in the dynamic symbol region; and a step for paying a payout for a combination of symbols formed on the display unit.

Further, a program according to one aspect of the present invention is program executed by a computer including an operation unit that accepts operation by a player, a display unit where a plurality of reels having symbols is displayed, the computer connected to the operation unit and the display unit wherein at least one of the plurality of reels has a static symbol region that statically displays a symbol selected from a first symbol set and a dynamic symbol region that, after displaying while varying symbols included in a second symbol set, stops the variation and indicates a predetermined symbol; wherein the program executes in the computer, a function, in accordance with the operation unit accepting an operation by a player, for varying the symbols displayed on the display unit by a combination of a process that rotates the plurality of reels and a process the varies the type of symbols in the dynamic symbol region; a function for stopping a symbol displayed on the display unit by a combination of a process that rotates and stops the plurality of reels and a process that stops the variation of the type of symbol displayed in the dynamic symbol region; and a function paying a payout for a combination of symbols formed on the display unit.

Effect of the Invention

According to one aspect of the present invention, progress for games having even more variation than a conventional gaming machine is achieved, and a gaming machine, a method and program for providing a game that can provide even higher entertainment value to a player is provided.

A gaming machine according to an embodiment of the present invention referencing the attached figures is described in detail below.

Further, duplicated descriptions will be omitted for identical attached symbols in identical or corresponding parts in each figure.

DESCRIPTION OF EMBODIMENTS

First Embodiment

Figure 1:
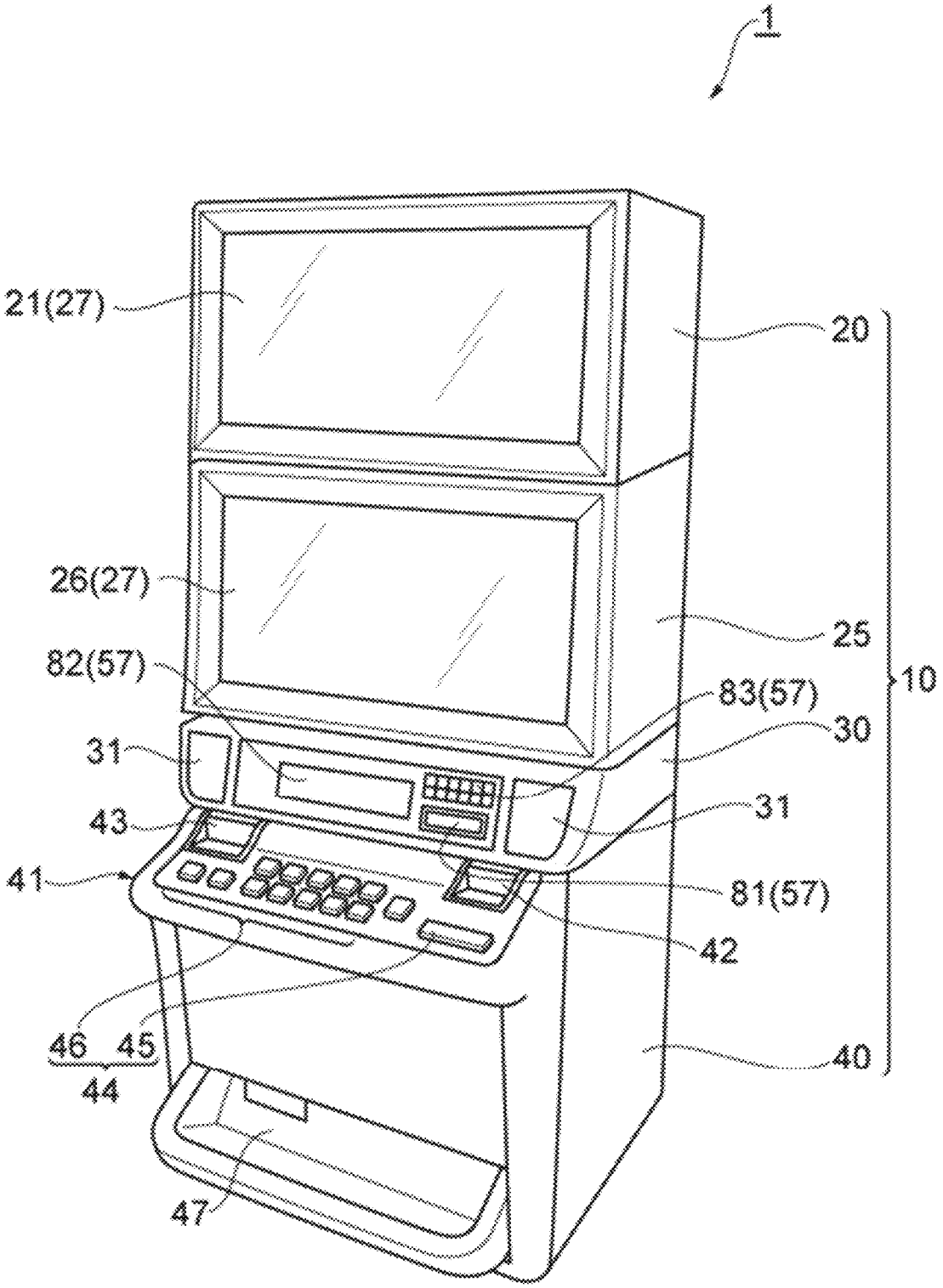
FIG. 1 is a perspective view of the gaming machine according to a first embodiment.

The gaming machine according to the first embodiment receives a predetermined game value from the player, generates a game result, and provides a payout to the player according to the game result. FIG. 1 is a perspective view of a gaming machine 1 according to the first embodiment. As shown in FIG. 1, this gaming machine 1 provides a first cabinet 20 providing an upper display 21, a second cabinet 25 providing a lower display 26, a third cabinet 30 that houses a player tracking unit 57 and a control panel 41, and has a housing 10 configured from a fourth cabinet 40 that houses a control unit 50 that controls each part. Each configuration is described below.

The first cabinet 20 is provided on the upper part of the housing 10, and the second cabinet 25 is provided below the first cabinet 20. The upper display 21 provided on the first cabinet 20 and the lower display 26 provided on the second cabinet 25, are flat panel display devices such as both liquid crystal display devices and organic EL display devices and the like, and by controlling via each control unit 50 the game screen mentioned below functions as a display unit 27 provided to the player.

The third cabinet 30 is provided below the second cabinet 25. Speakers 31 are provided on the left and right of the front surface of the third cabinet 30, and by controlling via the control unit 50, sound is provided to the player. Further, the player tracking unit 57 is housed on the center of the front surface of the third cabinet 30. The player tracking unit 57 has a card reader 81 that recognizes a player identification card, a display 82 that presents data to the player, and a keypad 83 that receives input by the player. This type of player tracking unit 57, reads information recorded on the player identification card inserted by the player into the card reader 81, and displays the information and/or information acquired by communicating with the external system on the display 82, by cooperatively operating with the control unit 50 mentioned below or an external system. Further, input from the player is received by the keypad 83, the display of the display 82 is changed according to the input, and communication with the external system is carried out as necessary.

The fourth cabinet 40 is provided below the third cabinet 30. On the fourth cabinet 40, one part is made to project from a front side, and the control panel 41 is provided. On the control panel 41, a bill/ticket identification unit 42, the printer unit 43, and an operation part 44 are provided.

The bill/ticket identification unit 42 is disposed on the control panel 41 in a state where the insertion opening that a bill or ticket is inserted into is exposed, an identification part that identifies a bill/ticket by various sensors on the inside of the insertion opening is provided, and a bill/ticket storage part is provided on the outgoing side of the identification part on the inside of the fourth cabinet 40. The bill/ticket identification unit 42, receives and identifies bills and tickets (including vouchers and coupons) that are the game value as a game executing value, and notifies the control unit 50 mentioned below.

The printer unit 43, is disposed on the control panel 41 in a state where the ticket output opening that a ticket is output from is exposed, a printing part that prints predetermined information on a printing paper on the inside of the ticket output opening is provided, and a housing part that houses the printing paper inside the paper inlet side of the printing part is provided. The printer unit 43, under the control of the control unit 50 mentioned below, prints information on paper and outputs a ticket according to credit payout processing from the gaming machine 1. The output ticket can use the payout credit as game play by being inserted into the bill/ticket identification unit of another gaming machine, or, can be exchanged for cash by a kiosk terminal inside of the casino or a casino cage.

The operation part 44 is a group of buttons that receives various instructions from the player on the gaming machine 1. The operation part 44, for example, has a spin button 45 and a group of setting buttons 46. The spin button 45 receives an instruction to start (start rotating the reel) the game listed below. The group of setting buttons 46 includes a group of bet buttons, a group of line-designated buttons, a max bet button, and a payout button and the like. The group of bet buttons receives an instruction operation regarding the bet amount of credits (bet number) from the player. The group of line-designated buttons receive an instruction operation that designate a pay line (referred to as an effective line below) subjected to a line judgment below from the player. The max bet button, receives an instruction operation regarding the bet of the maximum amount of credits that can be at one time from the player. The payout button receives an instruction operation instructing a credit payout accumulated in the gaming machine 1.

Further, on the inside of the fourth cabinet 40, a control board equipped with a central processing unit 51 (abbreviated as CPU below) that configures the control unit 50, an interface part 52, a memory 53 and a storage 54 and the like is incorporated. The control board configured so that communication is possible through the interface part 52 and each of the components equipped on the first cabinet 20, the second cabinet 25, the third cabinet 30, and the fourth cabinet 40, controls the operation of each part by executing the program recorded in the memory 53 or the storage 54 of the CPU 51, and provides a game to the player.

Figure 2:
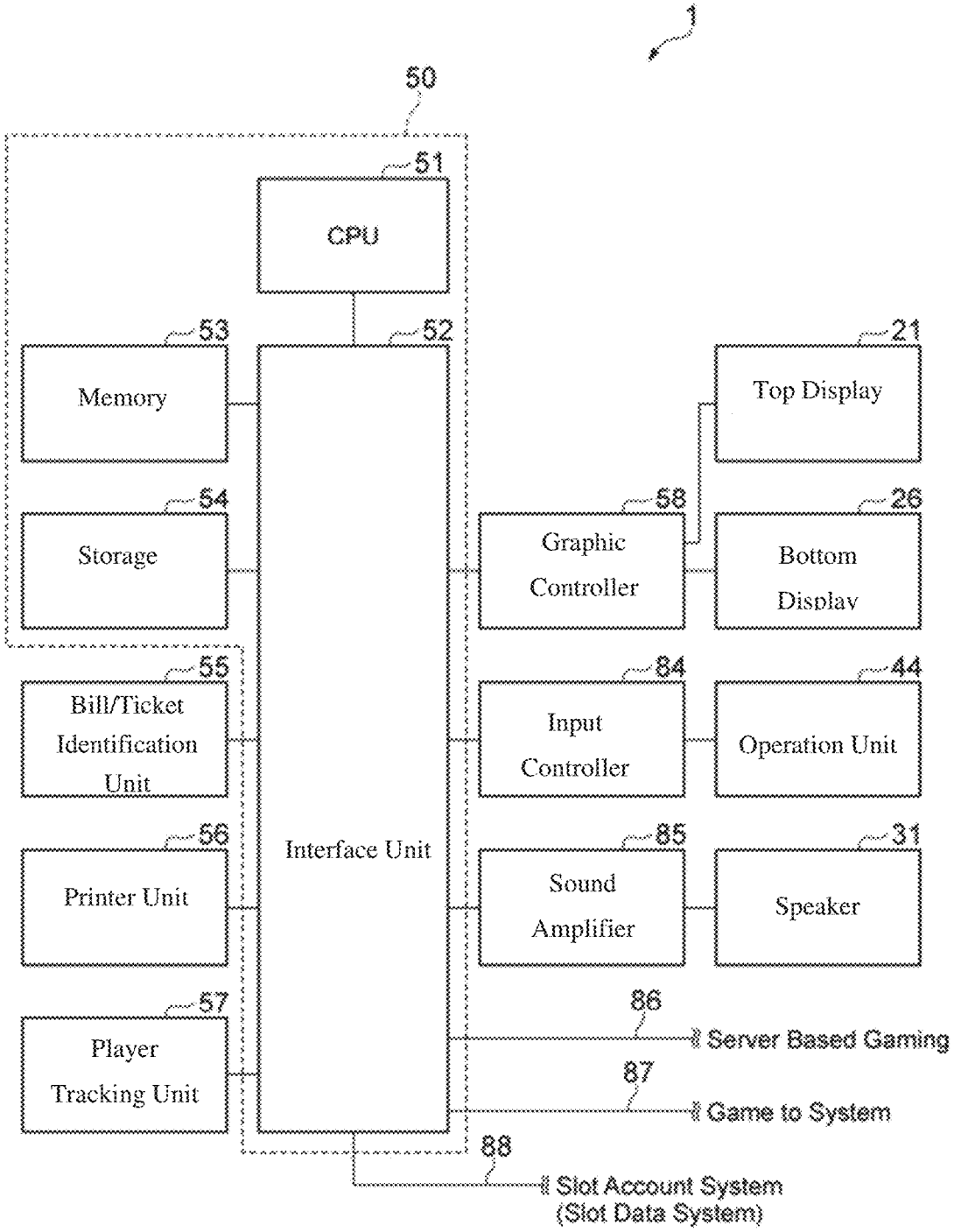
FIG. 2 is a block diagram of the gaming machine in FIG. 1.

FIG. 2 shows a functional block diagram of the gaming machine 1 according to the present embodiment. The gaming machine 1 provides the control unit 50. The control unit 50 is configured as the interface part 52 including a chip set providing communication functions of the CPU 51, a memory bus connected to a CPU, various expanding buses, serial interface(s), USB interface(s), Ethernet (registered trademark) interface(s) and the like, and a computer unit where the CPU 51 provides the addressable memory 53 and the storage 54 through the interface part 52. The memory 53 can be configured to include RAM that is a volatile storage medium, ROM that is a nonvolatile storage medium, and EEPROM that is a rewritable nonvolatile storage medium. The storage 54 provides the control unit 50 as an external storage device function, can use reading devices such as a memory card that is a removable storage medium, and a magneto optical disk and the like, and can use hard disks.

On the interface part 52, in addition to the CPU 51, the memory 53, and the storage 54, a bill/ticket identification unit 55, a printer unit 56, the player tracking unit 57, a graphic controller 58, an input controller 84, and a sound amp 85 are connected. Note that, when illumination that provides decorative lighting to the gaming machine 1 is provided, the illumination is controlled under the control of the control unit 50 on the interface part 52, and an illumination controller that provides a decorative lighting effect may be connected.

The control unit 50 that has such memory 53 and storage 54, controls each part by executing a program stored in the memory 53 and the storage 54, and provides a game to the player. Here, for example there may be a configuration that stores a program and data of an operating system and subsystem that provides the basic functions of the control unit 50 to the EEPROM of the memory 53, and stores a program and data of an application that provides a game to the storage 54. According to such a configuration, it can be easy to change or update a game by replacing the storage 54. Further, the control unit 50 may be a multiprocessor configuration that has a plurality of CPUs.

Each block connected to the control unit 50 is described below.

The bill/ticket identification unit 55 corresponds to the bill/ticket identification unit 42, receives bills or tickets in the insertion opening, and notifies the control unit 50 identifying information corresponding to the payout processing of an assortment of bills or credits. The bill/ticket identification unit 55 notifies the information to the control unit 50, and the control unit 50 increases the usable credit amount inside of the game according to the notified content. The printer unit 56 corresponds to the printer unit 43, and under the control of the control unit 50 that receives an operation of the payout button of the group of setting buttons 46, information corresponding to the credit payout processing from the gaming machine 1 is printed and output on a printed ticket.

The player tracking unit 57 cooperatively operates with the control unit 50, and sends and receives information and the like of the player between the casino management system. The graphic controller 58 controls the upper display 21 and the lower display 26, under the control of the control unit 50, and displays a display image that includes various graphic data. The sound amp 85 drives the speakers 31 under the control of the control unit 50, and provides various sounds such as an announcement, sound effects, BGM and the like.

Further, the interface part 52, has various communication interfaces for communicating with the exterior of the gaming machine 1, for example can communicate with an external network by Ethernet 86, 87, and a serial output 88. In the present embodiment, one example shows when there is communication between a well-known server side gaming network (Server Based Gaming of FIG. 2), a G2S network (Game to System of FIG. 2), and a slot information system (Slot Data System of FIG. 2), respectively.

Figure 3:
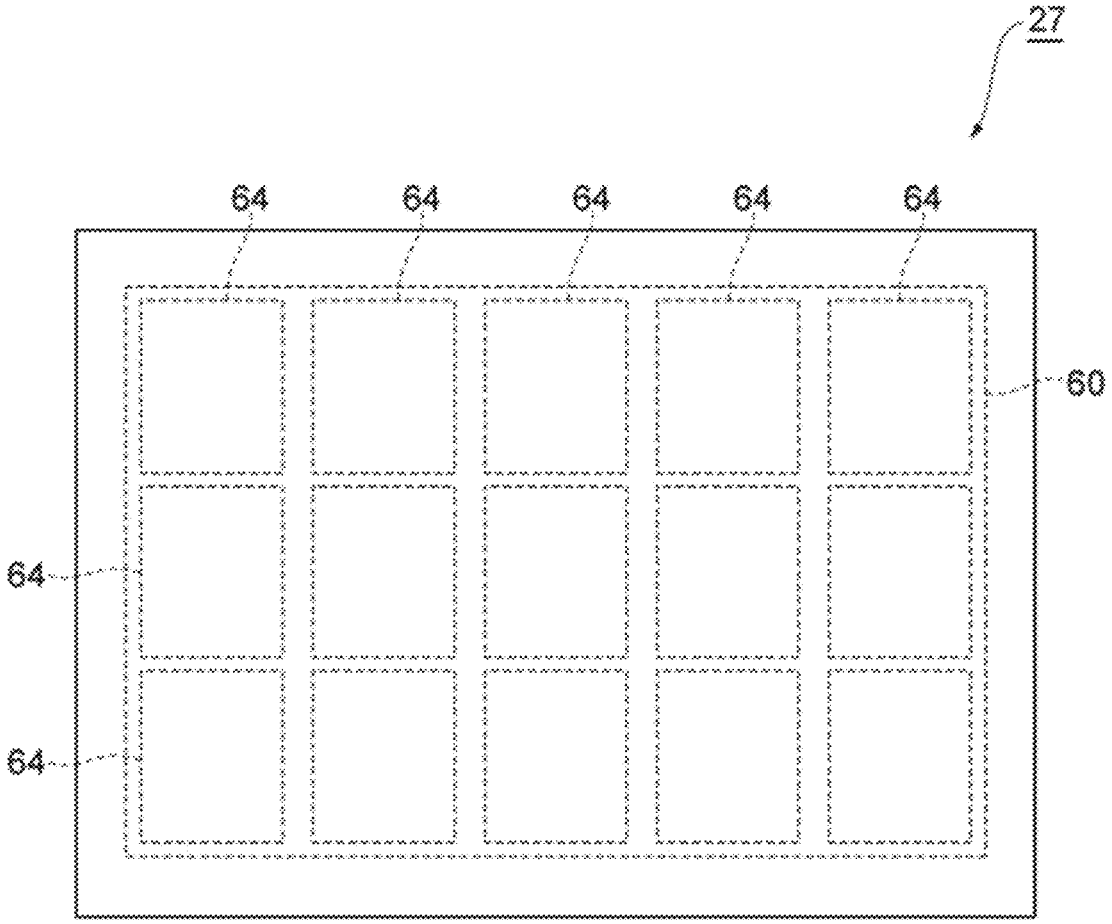
FIG. 3 is a schematic diagram illustrating one example of the symbol display region in the gaming machine in FIG. 1.

FIG. 3 is a figure schematically showing a game screen provided by the gaming machine 1 according to the present embodiment. Such a game screen displays on the display unit 27 (the upper display 21 and/or the lower display 26) by the control unit 50 executing a fixed program. The present embodiment shows the state of displaying the game screen on the lower display 26. As shown in FIG. 3, this game screen has a symbol display region 60 for displaying symbols. In using this type of game screen, the gaming machine 1 of the present embodiment displays game results by redisplaying symbols displayed in the symbol display region 60 in return for a predetermined game value, and operates as a slot machine that pays a payout according to the winning combination of symbols included in the game results.

It should be noted, though omitted in FIG. 3, that a credit amount, number of bets, a region for displaying a credit amount (number of WINs), and the like, obtained in wins, and a decoration region may also be provided in the display unit 27 other than the symbol display region 60.

The symbol display region 60 is configured by a plurality of cells 64, which is the stopping position of a symbol. Specifically, the symbol display region 60 is configured by 15 cells arranged in a grid pattern of 3 rows and 5 columns. It should be noted that below, the horizontal direction and the vertical direction of the display unit 27 are referred to as the row direction and the column direction respectively.

Figure 4:
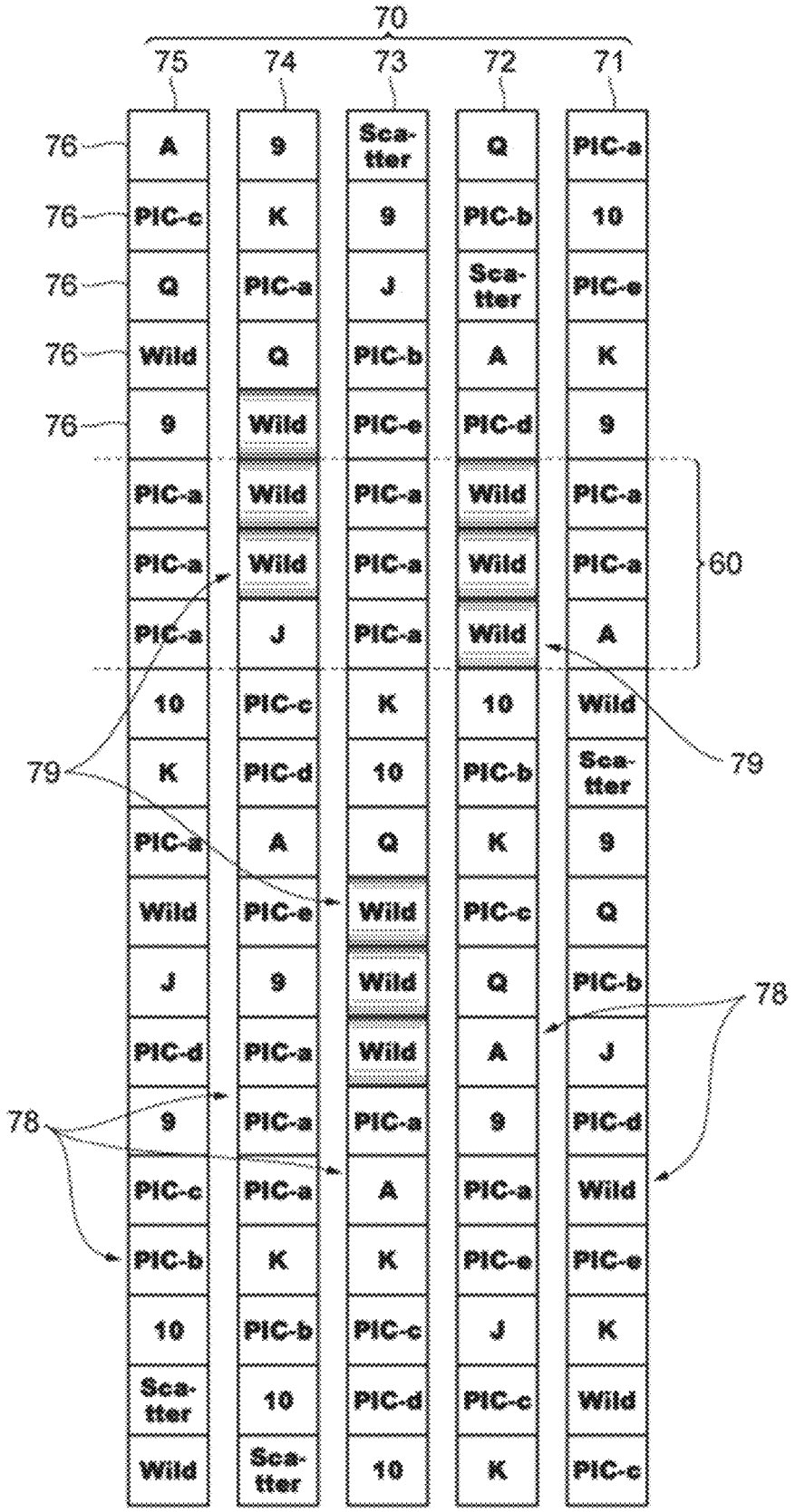
FIG. 4 is a diagram illustrating one example of the reel sequence displayed in the symbol display region in FIG. 3.

A symbol in a reel sequence for each virtual reel strip 71 to 75 is partially displayed in each cell 64 in the symbol display region 60 based on the reel sequence in the virtual reel strips 71 to 75, which forms a virtual reel set 70 as illustrated in FIG. 4. Here, the virtual reel strips 71 to 75 are data configurations represented by the use of a program used by the control unit 50 in the memory 53 or the storage 54, and represents a state in which a plurality of symbols are aligned in a line as illustrated in FIG. 4. Further, the virtual reel set 70 is a generic name for this type of virtual reel strip 71 to 75. In the present embodiment, three symbols in the virtual reel strip 71 to 75 are each displayed in the symbol display region 60.

The virtual reel strips 71 to 75 illustrated in FIG. 4 each have 20 symbol regions 76. Either the 13 types of symbol sets illustrated in FIG. 5(*a*) (first symbol set) or the four types of symbol sets of the multiplier wild symbols illustrated in FIG. 5(*b*) (second symbol set) are displayed in each symbol region 76. It should be noted that in FIG. 4, and the like, various picture symbols such as a treasure box or a diamond represent "PIC-a," "PIC-b," "PIC-c," "PIC-d," and "PIC-e" in a simplified manner. Further, in FIG. 4, and the like, a wild symbol is represented by "Wild", and a scatter symbol is represented by "Scatter."

The wild symbol is a symbol that passes as another symbol (that is a symbol substituted as another symbol) upon a winning determination in a normal game, described below, and can configure a winning combination with an unspecified symbol. The multiplier wild symbol is a wild symbol to which a multiple is applied, and the multiple applied to the symbol multiplies the amount of a winning payout when a winning combination is configured by the symbols. It should be noted that a design indicating a multiple may be employed in the multiplier wild symbol in order to explicitly indicate to a player that a wining payout is being multiplied by the multiple. The scatter symbol is a symbol used upon the winning determination of a special game, described below, and is provided in a special game according to the number of scatter symbols in the symbol display region 60.

The symbol region 76 in the virtual reel strips 71 to 75 described above includes a static symbol region 78 and a dynamic symbol region 79.

The static symbol region 78 is a symbol region that statically displays a symbol, and in the reel sequence illustrated in FIG. 4 the symbol region 76, which displays 12 types of symbols excepting the wild symbol, is a static symbol region 78. Symbols in the static symbol region 78 are arranged in a predefined order and behave as if on, or printed on, the virtual reel strips 71 to 75. That is the symbols in the static symbol region 78, in conjunction with the rotation of the virtual reel strips 71 to 75, move at the same rotational speed as the rotation speed of the virtual reel strips 71 to 75.

The dynamic symbol region 79 is a symbol region capable of displaying while varying symbols. More specifically, the dynamic symbol region 79 displays while varying symbols when a predetermined condition is met, and is a symbol region wherein varying is stopped thereafter and a predetermined type of symbol is displayed. In the present embodiment, the dynamic symbol region 79 varies the symbols upon provision of the special game described earlier without varying the symbols in the dynamic symbol region 79 during a normal game.

In the present embodiment, the dynamic symbol region 79 is configured of a plurality of the symbol regions 76, and is virtually displayed by a sub-reel within each symbol region 76 when the symbols are varied. The sub-reel is an independent reel that rotates and stops independent of the reels regulated by the virtual reel strips 71 to 75, and can display while varying symbols in the symbol region 76 through rotation of the sub-reel. It should be noted that each sub-reel is stereoscopically displayed as a cylindrical reel extending in the left and right directions (row direction of the symbol display region 60) within the symbol region 76 via three-dimensional computer graphics.

In the reel sequence in FIG. 4, virtual reel strips 72, 73, and 74 each include the dynamic symbol region 79, and each dynamic symbol region 79 is configured of three symbol regions 76 displaying a wild stack (a continuous group of symbols composed of three continuous "Wilds"). These dynamic symbol regions 79 each display a wild symbol on a sub-reel that does not rotate during a normal game, and each displays a sub-reel that rotates as appropriate during a special game. Below, for the sake of description, the sub-reel described above that displays on the dynamic symbol region 79 of the virtual reel strips 72, 73, and 74 is referred to as a wild sub-reel.

Figure 5A:
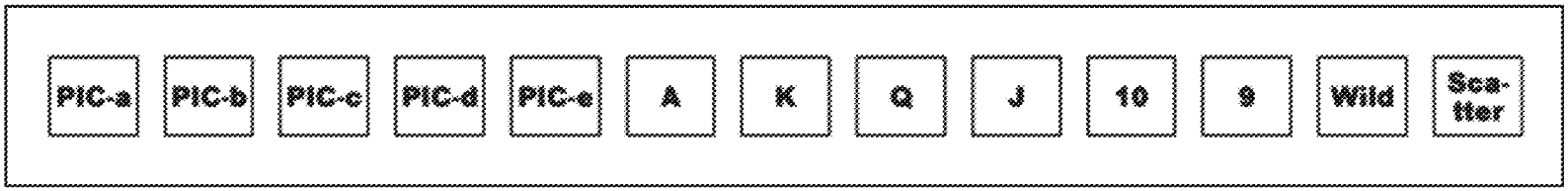
FIGS. 5A and 5B are diagrams illustrating symbol sets of the symbols displayed in the symbol display region in FIG. 3.
Figure 5B:
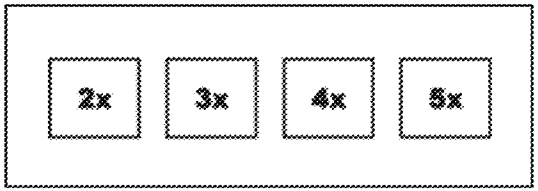

Each wild sub-reel displays while varying a multiplier wild symbol selected from the symbol set illustrated in FIG. 5(*b*) (second symbol set) during a special game, stops varying thereafter, and displays any of the multiplier wild symbols.

Figure 6:
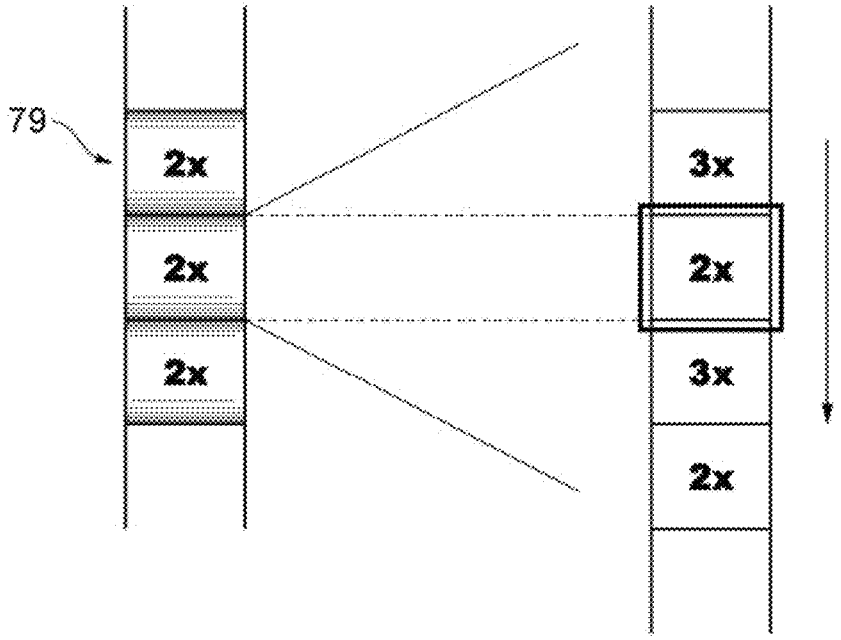
FIG. 6 is a diagram illustrating a symbol that is rotated and displayed in a wild sub-reel.

Below, the sub-reel of the present embodiment (that is the wild sub-reel) is described in detail. The wild sub-reel displayed in the dynamic symbol region 79 of the virtual reel strip 74 is composed of an even number (eight for example) of cells, and cells displaying a "2×" in a multiplier wild symbol and cells displaying a "3×" in a multiplier wild symbol are alternately arranged as illustrated in FIG. 6. Similarly, in each wild sub-reel of the virtual reel strip 73, cells displaying a "2×" in a multiplier wild symbol and cells displaying a "4×" in a multiplier wild symbol are alternately arranged, and in each wild sub-reel of the virtual reel strip 72, cells displaying a "2×" in a multiplier wild symbol and cells displaying a "5×" in a multiplier wild symbol are alternately arranged.

Further, three wild sub-reels aligned in the same virtual reel strips 72 to 74 rotate in synchronization upon rotation, and multiplier wild symbols of the same type are varied and displayed, and stopped and displayed in the virtual reel strips 72 to 74. Synchronization of the three wild sub-reels means that a same symbol is always displayed by rotation of the three reels in a same direction and at a same rotational speed. As an example, in the virtual reel strip 74 when one wild sub-reel stops and displays a "2×" multiplier wild symbol, the other two sub-reels also stop and display a "2×" multiplier wild symbol, further, when one wild sub-reel stops and displays a "3×" multiplier wild symbol, the other two sub-reels also stop and display a "3×" multiplier wild symbol. Further, upon varying and display, the varying and display of a symbol displayed in one wild sub-reel and the varying and display of a symbol displayed in two other wild sub-reels are matched at an arbitrary timing.

The control unit 50, which starts a game, randomly determines a stopping position for each of the virtual reel strips 71 to 75 described above, the virtual reel strips 71 to 75 move from their current positions, and the operation of stopping at a stopping position is expressed using the display unit 27 (the bottom display 26 for example). By this, in the symbol display region 60, a symbol arrayed on the virtual reel strips 71 to 75 continuously moves (scrolls) in the vertical direction, and is stopped so as to display one symbol in one cell 64 while maintaining continuity.

Figure 7:
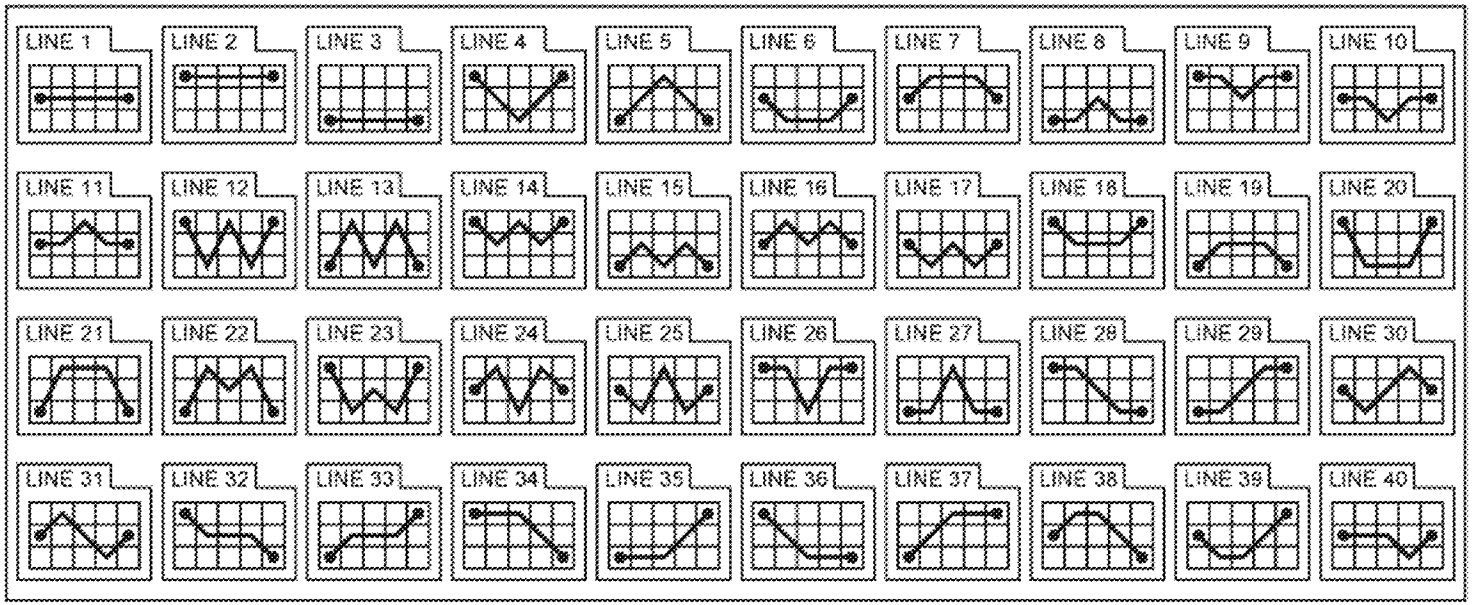
FIG. 7 is a diagram illustrating one example of a pay line set in the symbol display region.

A pay line used upon a winning determination is set in the symbol display region 60. The pay line is set so as to span from a cell in the column on the left edge to a cell in the column on the right edge, and is a line composed of the combination of a plurality of cells 64 that form the objective of a winning determination. The number of an effective line in a set pay line is selected by a player via operation of a group of line-designated buttons included in the group of setting buttons 46 in the operation unit 44. For a symbol sequence, which is a game result, the control unit 50 determines a win, for example, when a same symbol exceeds a predetermined number and is aligned on a set pay line, and pays a player a payout according to the type of symbol and the number. In the gaming machine 1 of the present embodiment, a predetermined number of pay lines (LINE 1 to 40) are set for a three row five column cell in the symbol display region 60 (reference FIG. 7). The method for a winning determination may determine a win when a predetermined number of a same symbol are aligned on a predetermined pay line from a cell in the column on the left edge, may determine a win when a predetermined number of a same symbol are aligned on a predetermined pay line from a cell in the column on the right edge, or may determine a win when a predetermined number of a same symbol are aligned in any adjacent columns on a predetermined pay line.

It should be noted that a boundary line of the cells 64 may be displayed on the display unit 27 in a state that is visually comprehensible to a player, or the display may be omitted. That is, the cells 64 are sufficient if logically or ideally defined within the gaming machine 1 as a symbol stopping position, and a visible boundary therefor is not necessarily required.

The gaming machine 1 for the present embodiment provides two types games including a normal game, which is provided when a predetermined condition is not met (also referred to as a main game or a prime game), and also a special game, which is provided when a predetermined condition is met as a trigger event (also referred to as a bonus game or feature game, including a free game provided without consuming a game value). In the normal game and the special game, a symbol displayed in the symbol display region 60 in a symbol sequence, which is a game result, becomes the objective of a winning determination.

Figures 8A, 8B:
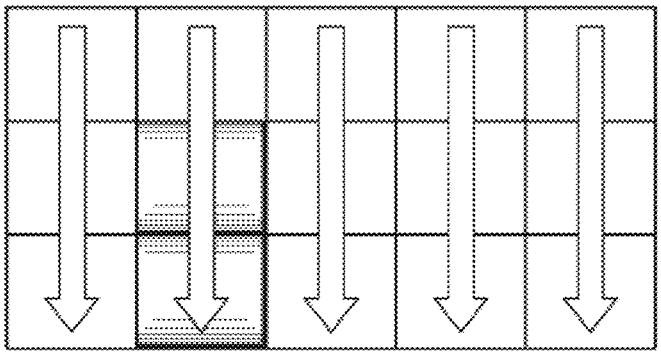
FIGS. 8A and 8B are diagrams illustrating the display state of a wild stack in a normal game.

In a normal game, the dynamic symbol region 79 described above statically displays a symbol (i.e., a wild symbol) in a similar manner to the static symbol region 78 that displays a symbol other than a wild symbol. That is, when a virtual reel strip rotates, the dynamic symbol region 79 rotates while fixedly displaying a wild symbol along with the rotation of the reel, and thereafter if the virtual reel strip stops, the wild symbol in the dynamic symbol region 79 also stops, as illustrated in FIG. 8(*a*). At this time, if the stopped position of the dynamic symbol region 79 is within the symbol display region 60, a wild symbol in the dynamic symbol region 79 is stopped and displayed in the symbol display region 60 as illustrated in FIG. 8(*b*).

Figure 9A:
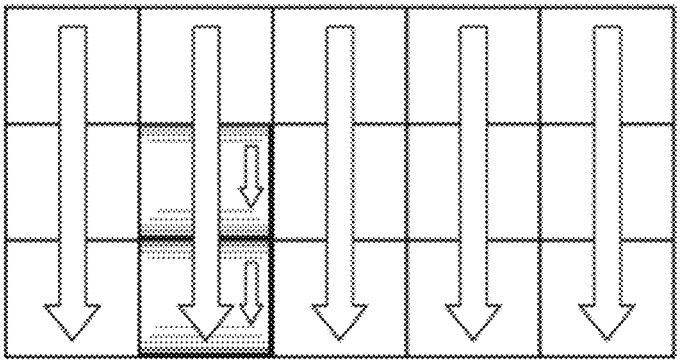
FIGS. 9A, 9B, and 9C are diagrams illustrating the display state of a wild stack in a special game.
Figure 9B:
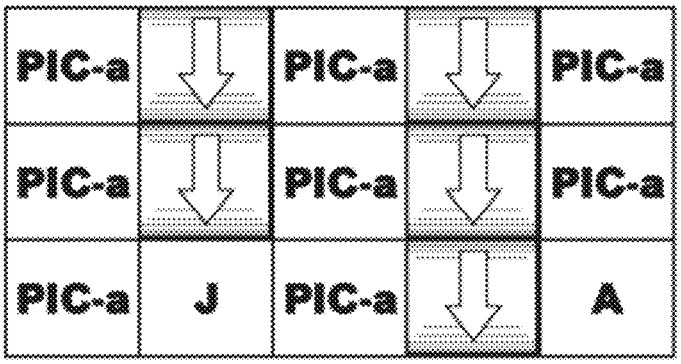
Figure 9C:
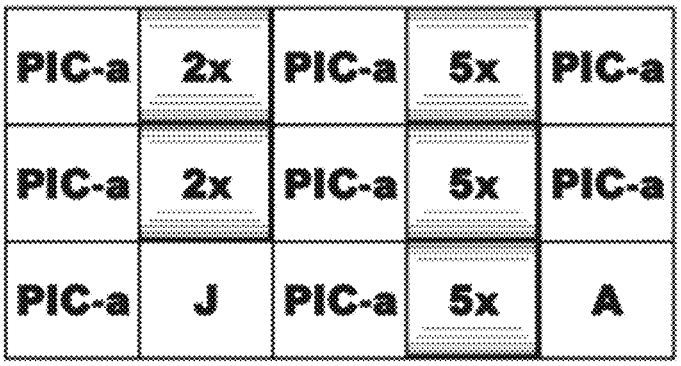

In a special game, the dynamic symbol region 79 described above stops varying and displays any predetermined type of multiplier wild symbol after varying a wild sub-reel and displaying while varying a symbol. Here, one example of a state wherein a wild sub-reel is rotated is described. First, if a special game is started, the control unit 50 rotates a virtual reel strip and also rotates a wild sub-reel in the dynamic symbol region 79 as illustrated in FIG. 9(*a*). Further, the control unit 50 determines a stopping position for each virtual reel strip, and stops and displays all of the virtual reel strips. Even after the virtual reel strips stop, rotation of the wild sub-reel in the symbol display region 60 continues, as illustrated in FIG. 9(*b*). Further, the control unit 50 determines a stopping position for the wild sub-reel displayed in the symbol display region 60, and stops and displays all of the wild sub-reels. As a result, as shown in FIG. 9(*c*), one multiplier wild symbol is stopped and displayed on a wild sub-reel in the dynamic symbol region 79.

It should be noted that the determination timing for the stopping position of a virtual reel strip and a wild strip through the control unit 50 is not limited to the timing described above. For example, the stopping position for both a virtual reel strip and a wild sub-strip may be determined based on a random number acquired at the start time of a special game. Further, even the timing for rotational start and rotational stop for the virtual reel strip and the wild sub-strip, respectively, by the control unit 50 are not limited to the timing described above. For example, the control unit 50 may first rotate and stop only a virtual reel strip and start rotation of a wild sub-reel thereafter. In this type of embodiment, because symbol varying in the symbol display region 60 is provided in two stages including a stage for the rotation and stop of a virtual reel strip and a stage for the rotation and stop of a wild sub-reel, a process leading to a win is presented to a player in stages which can effectively improve the sense of anticipation and excitement that a player feels. Further, the control unit 50 may rotate a virtual reel strip and rotate a wild sub-reel and simultaneously stop rotation of the virtual reel strip and rotation of the wild sub-reel in a predetermined timing. In this type of embodiment, because the varying of a symbol by a virtual reel strip and a wild sub-reel stops at one time, a rhythmical game with a pleasant feel can be provided to a player.

Figure 10:
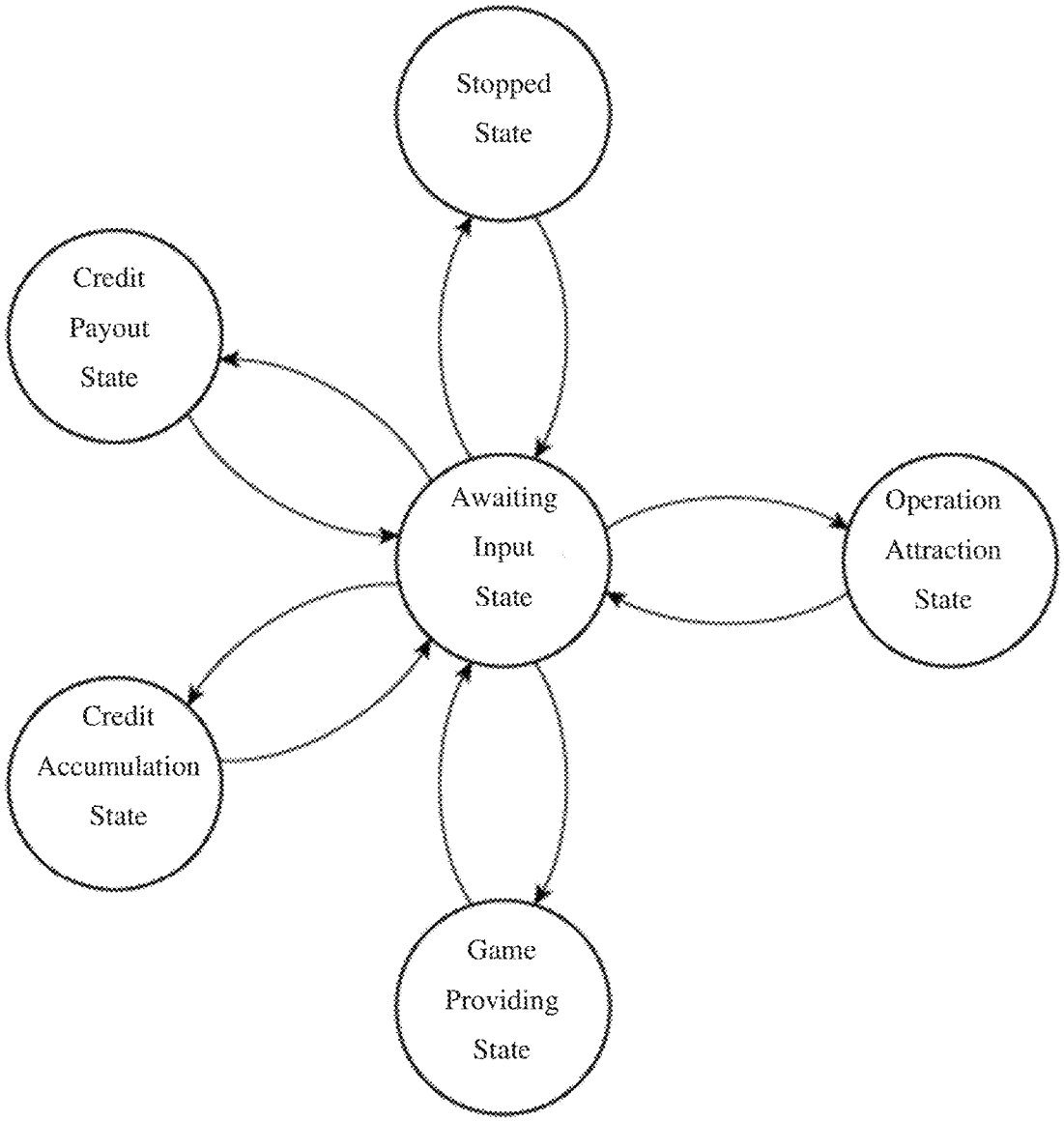
FIG. 10 is a state transition diagram of the gaming machine in FIG. 1.

Next, an operation of the gaming machine 1 according to the present embodiment is described while referencing FIG. 10. FIG. 10 is an illustration of a state transition diagram of the gaming machine 1 according to the present embodiment configured as described above. As illustrated in FIG. 10, the gaming machine 1 takes on each state including a stopped state, an awaiting input state, a credit payout state, a credit accumulation state, an operation attraction state, and a game providing state. Each state is described below.

The stopped state is a state wherein the gaming machine 1 is not operating. The gaming machine 1 in the stopped state accepts a predetermined activation operation, activates and initializes, a predetermined program is executed by the control unit 50, a game screen is displayed on the bottom display 26, and shifts to the awaiting input state.

The gaming machine 1 in the awaiting input state transitions to a credit accumulation state, which accumulates corresponding credit information within the gaming machine 1 whenever the bill/credit identification unit 55 identifies a bill or a credit, and returns to the awaiting input state when credit accumulation has ended. Further, the gaming machine 1 in the awaiting input state transitions to the credit payout state, which carries out accumulated credit payout processing, when an operation of the payout button is received in a state wherein credit information is accumulated, and along with outputting a ticket printed with information corresponding to the credit payout processing from the printer unit 56, accumulated credit within the gaming machine 1 returns to zero. The gaming machine 1, having finished these processes, returns to the awaiting input state.

The gaming machine 1 in the awaiting input state transitions to the operation attraction state, which displays an attractive screen on the top display 21 and the bottom display 26, if not operated within a predetermined time. The gaming machine 1 in the operation attraction state returns to an awaiting input state when an operation is received. It should be noted that the attractive screen is a screen meant to draw the attention of customers in the casino to the existence of the gaming machine 1, and is composed of a predetermined image and/or video.

The gaming machine 1 in the awaiting input state sets a line number and a bet number in a game by receiving an operation from a line selection button, a bet number selection button, or a max bet button in a state wherein credit has been accumulated within, and along with decreasing credit amount only by a line number multiplied by a credit amount set via reception of the operation of a start button, transitions to a game providing state. In the game providing state, a game is provided according to the flowchart illustrated in FIG. 11.

Figure 11:
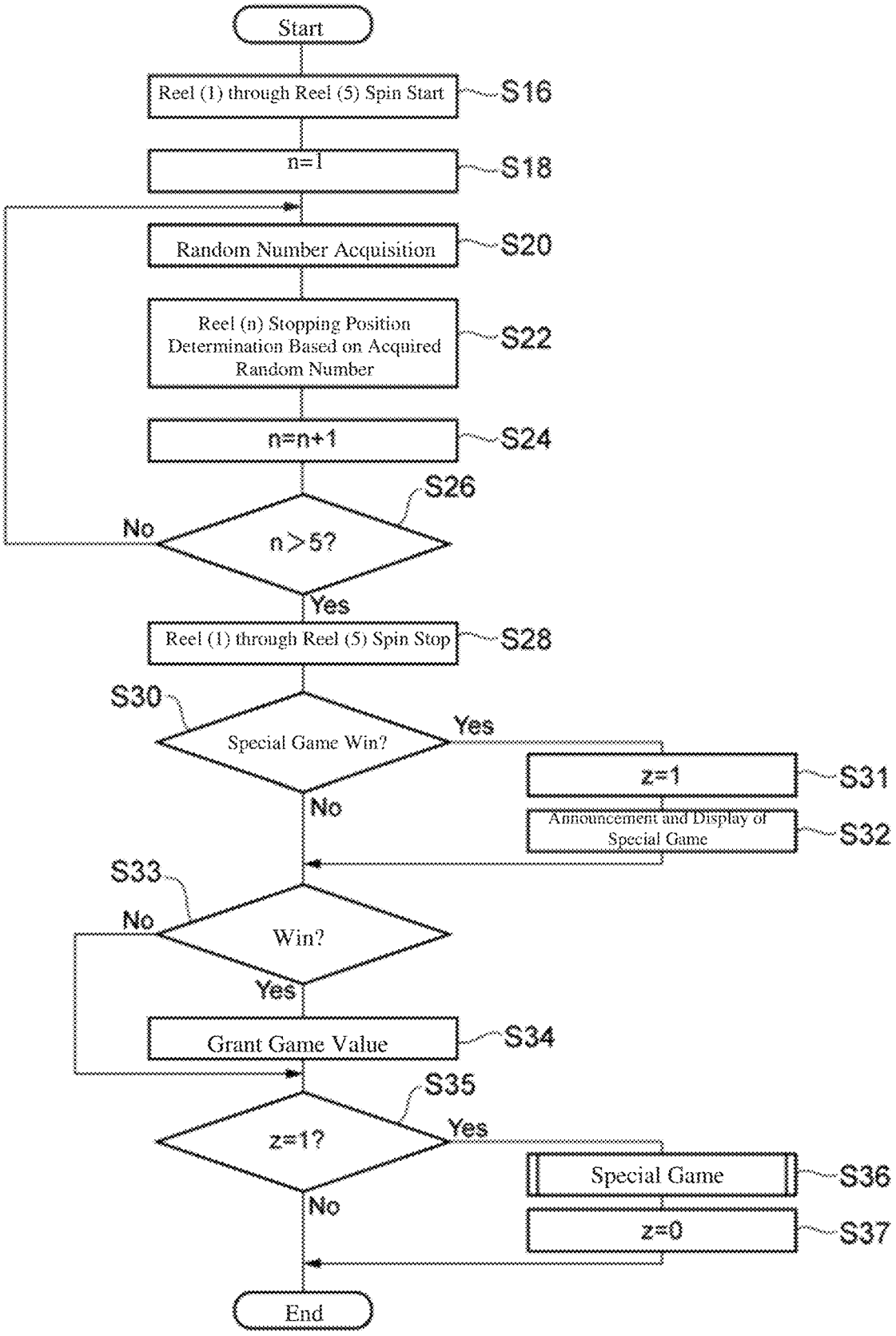
FIG. 11 is a flowchart describing the operation of the gaming machine in FIG. 1.

Below, an operation in the game providing state is described as a method for controlling for the gaming machine 1 while referencing the flow chart illustrated in FIG. 11.

A line number and a bet number are set in the awaiting input state, the gaming machine 1 having transitioned to the game providing state by receiving an operation from the start button starts a normal game by controlling the top display 21 and the bottom display 26 via the control unit 50.

First, a spin of reel (1) through reel (5) being displayed in the symbol display region 60 is started in S16. More specifically, a column of symbols being displayed in the symbol display region 60 are scrolled in a defined order in each corresponding virtual reel strip 71 to 75, and a state where the reels are rotating is virtually displayed. Subsequently, a parameter of n=1 is set as an initial process by the control unit 50 in the S18 process.

Next, in S20 process, the control unit 50 acquires a random number. The means whereby the control unit 50 acquires a random number may be in accordance with the regulations of a region wherein the gaming machine 1 is installed, but is not limited to a particular means. Further, before a spin start time or before a spin start for reel (1) through reel (5), the control unit 50 may acquire a necessary number of random numbers in advance (for example five random numbers to determine the stopping position for each reel). In this case, determination of a stopping position or a special game win can be stored by completing a determination of the presence or absence of a win at an early stage in a game. After acquisition of a random number, the process proceeds to S22.

In the S22 process, the control unit 50 determines a stopping position for a reel (n) based on a random number acquired in the S20 process. Here, the stopping position for a reel (n) corresponds to the stopping position of a corresponding virtual reel strip 71 to 75. Therefore, the stopping position defines a numerical value or a scope of a numerical value in relation to each symbol in the virtual reel strips 71 to 75, for example, and can determine a position of a symbol related to a numerical value or a scope of a numerical value including an acquired random number. In this case, by unevenly defining a numerical value or a scope of a numerical value related to each symbol, a gradient or a bias in the probability of a stopping position can also be provided. After the determination of a stopping position for a reel (n), the process proceeds to S24.

In the S24 process, the control unit 50 is made to be n=n+1. After setting, the process proceeds to S26. In the S26 process, whether or not the control unit 50 satisfies n>5 or not is determined. When n>5 is not satisfied, the process proceeds to S20. By this, until n>5 is satisfied, processes S20 to S26 are repeatedly executed. By this, stopping positions for reel (1) through reel (5) are determined. In S26, when n>5 is satisfied, the process proceeds to S28 because a determination of the stopping positions for all of reel (1) through reel (5) is indicated.

In the S28 process, the control unit 50 stops reel (1) through reel (5) based on the stopping positions of each virtual reel strip 71 to 75, which are determined by the S22 process. More specifically, a symbol column scroll-displayed in the symbol display region 60 is stopped at a stopping position determined for each virtual reel strip 71 to 75.

After the S28 process and in the S30 process, the control unit 50 determines whether a symbol displayed in the symbol display region 60 satisfies a predetermined condition for providing a special game. As the predetermined condition for providing a special game, forming of a winning combination of symbols predetermined on the pay line (line determination) and/or the appearance of a special symbol (scatter symbol) equal to or greater than a predetermined number in the symbol display region 60 (scatter determination) may be given as examples.

In the present embodiment, a scatter determination is used in a winning determination of a special game. As illustrated in FIG. 4, one scatter symbol each is included in virtual reel strips 71 to 75 and five scatter symbols are included in the entire virtual reel set 70, and when three or more scatter symbols are displayed within the symbol display region 60, the control unit 50 determines that a condition providing a special game has been satisfied. In the present embodiment, as a special game, a free game that does not consume game value is provided a predetermined number of times. The control unit 50 determines the number of free games provided as a special game according to the number of scatter symbols. That is, when three or more scatter symbols are displayed within the symbol display region 60 and provision of a special game is determined, the control unit 50 determines that three free games are provided when two scatter symbols are displayed, eight free games are provided when three scatter symbols are displayed, twelve free games are provided when four scatter symbols are displayed, and twenty free games are provided when five scatter symbols are displayed.

When a predetermined condition providing a special game is determined to have been satisfied by S30, a special game providing flag Z is set to Z=1 by S31. After a flag is set by S31, provision of a special game is announced and displayed in the top display 21 or the bottom display 26 by S32.

After S32, when a predetermined condition providing a special game is determined to have been satisfied by S30, in S33 the control unit 50 determines whether a symbol displayed in the symbol display region 60 is a win. For example, the predetermined condition providing a special game by the line determination and/or the scatter determination described above is applied in a different condition and determined whether or not to be a win. When determined to be a win, in S34, credit corresponding to a payout is added to the accumulated credit in the gaming machine 1 because the payout, being a predetermined game value (credit), is granted to a player.

After S34, when determined to be a win by S33, and after S33, when not determined to be a win, subsequently, whether a flag Z is set to Z=1 is determined by the S35 process, and when determined to be set to Z=1, the process progresses to S36 and the control unit 50 provides a predetermined number of free games described above as a special game. It should be noted that when a predetermined condition is satisfied during a free game, a modification such as the addition of a number of free games is added in place of the provision of a special game when another predetermined condition is satisfied, and the process proceeds.

When the predetermined number of free games have ended, a flag Z is set to Z=0 by the S37 following S36, the gaming machine 1 ends the game providing state and returns to the awaiting input state. Further, when determined that a flag Z is not set to Z=1 by S35, the gaming machine 1 ends the game providing state and returns to the awaiting input state. Operation in the game providing state described above ends.

Figure 12:
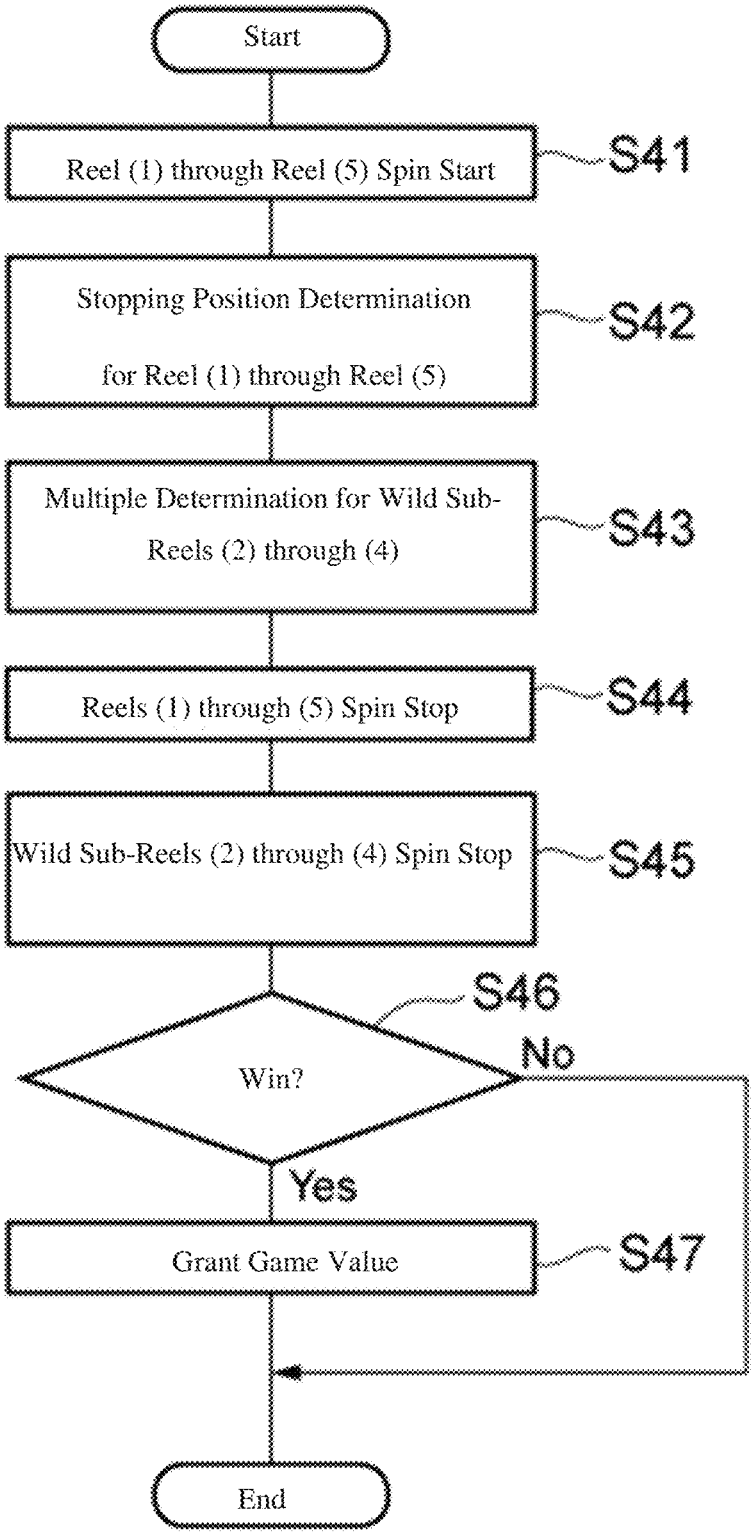
FIG. 12 is a flowchart describing the process of the special game in FIG. 11.

Here, one game worth in a plurality of free games provided in S36 is described with reference to the flowchart in FIG. 12.

First in S41, similar to S16 described above, the control unit 50 starts spinning the reel (1) through reel (5) displayed in the symbol display region 60. During a reel spin, the reel moves at a same rotational speed as the rotational speed in the virtual reel strips 71 to 75 with regard to a symbol in the static symbol region 78 of the virtual reel strips 71 to 75. Further, during a reel spin, the dynamic symbol region 79 itself moves at a same rotational speed as the rotational speed in the virtual reel strips 71 to 75 with regard to a symbol in the dynamic symbol region 79 of the virtual reel strips 71 to 75, but even in the dynamic symbol region 79 a symbol is varied.

In the S42 process following S41, the control unit 50 repeatedly carries out the same process as described for S18 to S26, and determines a stopping position for the reels (1) through (5).

In the S43 process, the control unit 50 acquires a random number in the same manner as the random number acquisition described for S20 above, and determines a multiplier wild symbol that stops and displays on a sub-reel using the random number. The control unit 50 may collectively acquire a required number of random numbers (for example a maximum of three random number for determining a multiple for each wild sub-reel) at one time before the spin start time or the spin start in S41.

In the S44 process, the control unit 50 stops all of reel (1) through reel (5) in order from the left side of the symbol display region 60 based on the stopping positions for each virtual reel strip 71 to 75, which are determined by the S42 process (reference FIG. 8(*a*) and FIG. 8(*b*)). At the moment when the reel (1) through reel (5) stops, a sub-reel still continues to rotate.

In the S45 process, the control unit 50 stops rotation of the wild sub-reel displayed in the symbol display region 60 (reference FIG. 8(*b*) and FIG. 8(*c*)). When the wild sub-reel is displayed on a plurality of reels in the symbol display region 60, the reels are stopped in order from the left reel.

In S46 the control unit 50 determines whether a symbol display in the symbol display region 60 is a win. When determined to be a win, a payout, being a predetermined game value (credit) is calculated by the S47 process, and added to credit accumulated in the gaming machine 1 by credit corresponding to the calculated payout. When a payout is calculated, a win type is determined from the winning combination of symbols formed on a pay line of the symbol display region 60, and thereafter the control unit 50 multiplies and grants to a player a multiple of the multiplier wild symbol by the winning payout when a multiplier wild symbol in a wild-reel is included in the winning combination.

It should be noted that an embodiment may multiply a predetermined multiple by a payout only when a winning combination is configured by a multiplier wild symbol, further, an embodiment may multiply a predetermined multiple with respect to the total payout of all winning combinations when the multiplier wild symbol is displayed on the symbol display region 60. The method for multiplying a multiple by a payout can be changed appropriately according to the type or content of a game.

When a winning combination is configured by two or more multiplier wild symbols, the product of the multiples for each multiplier wild symbol is multiplied by a payout. For example, when a winning combination is configured by two or more multiplier wild symbols, when the multiple for one multiplier wild symbol is "2" and the multiple for another multiplier wild symbol is "3," a multiple of "6" is multiplied by a payout. It should be noted that an embodiment may multiply the sum of multiples in each multiplier wild symbol. For any of the embodiments described above, a constitution composed of a winning combination by two or more multiplier wild symbols will increase a payout even more than a constitution composed of a winning combination by one multiplier wild symbol.

For a special game in S36, the control unit 50 carries out the free game illustrated by S41 to S47 a number of times determined in S30.

According to the gaming machine and the game providing means therein according to Embodiment 1 described above, along with rotating the virtual reel set 70 during a free game, the control unit 50 also varies a type of multiplier wild symbol displayed by rotating a wild sub-reel arrayed in the dynamic symbol region 79 on the virtual reel strips 72 to 74. Further, after stopping rotation of all reels in the virtual reel set 70, rotation of a wild sub-reel is stopped, and the type of displayed multiplier wild symbol is determined.

That is, according to the present embodiment, while the virtual reel set 70 is rotating, because a type of multiplier wild symbol is varied and displayed in a wild sub-reel, the expected value for game results varies greatly and can provide to a player a game progression rich in variation according to a symbol displayed in the static symbol region 78 and the varying of a type of multiplier symbol in the dynamic symbol region 79.

Further, in the embodiment, rotation of the virtual reel set 70 stops, and even if one portion of a symbol combination in the symbol display region 60 is determined by a symbol displayed in the static symbol region 78, the combination of symbols in the entire symbol display region 60 are not determined until rotation of the wild sub-reel in the dynamic symbol region 79 stops. That is, even after rotation of the virtual reel set 70 has stopped, a wide variety of game results are provided to a player depending on whether the wild sub-reel stops by any type of multiplier wild symbol. Therefore, according to the present embodiment, an enthralling game progression can be provided until the end (that is, until the final game results are displayed).

In this way, according to the gaming machine and the game providing means therein according to Embodiment 1, game development rich in variation can be provided to a player until the end, and a game having high entertainment value can be achieved. In a different light, while a reel is rotating and even after reel rotation has stopped, interest in the game results of a player can be sustained and even expressed until symbol varying in the wild sub-reel has stopped because game results cannot even be inferred without a determination while a multiplier wild symbol in the wild sub-reel is varying.

Further, as described above, symbol sets in the wild sub-reel each differ in the virtual reel strips 72 to 74. Particularly, stop order for a wild sub-reel in the first virtual reel strip 74 is configured only by a multiplier wild symbol of a low multiple (that is "2×" and "3×"), a wild sub-reel in the virtual reel strip 73, being the next stopping order for a wild sub-reel in the virtual reel strip 74, includes a multiplier wild symbol of a higher multiple (that is "4×"), and further, stop order for a wild sub-reel in the last virtual reel strip 72 includes a multiplier wild symbol of a higher multiple (that is "5×").

Therefore, even when a multiplier wild symbol of a small multiple (that is "2×") is displayed by a wild sub-reel in the first virtual reel strip 74 to be stopped and displayed, if a multiplier wild symbol of a larger multiple (that is "4×" or "5×") is displayed by a wild sub-reel in the virtual reel strips 72 and 73, stopped and displayed thereafter, a high payout may occur. Therefore, even when a multiple in the virtual reel strip 74, which is stopped first, is small, a player can maintain interest in the game while expecting a high payout until a multiple in the virtual reel strip 72 is identified. It should be noted that even when a multiple in the virtual reel strip 74, which is stopped first, is large, a player expects the determination of a large multiple in the virtual reel strips 72 and 73, which are stopped and displayed thereafter, and can maintain interest in the game while expecting an even higher payout.

Further, as described above, three wild sub-reels aligned in the same virtual reel strips 72 to 74 rotate in synchronization when rotating. Therefore, visibility of the symbols increases among the three wild sub-reels aligned in the same virtual reels strips 72 to 74 even when a plurality of a wild sub-reel is displayed in the symbol display region 60. That is, because the plurality of a wild sub-reel always has the same display content, a player may recognize one type of display content without needing to individually recognize content displayed for all wild sub-reels. Therefore, unnecessary eye movements or scattered attention may be reduced during a game, and a player can comfortably enjoy the game. It should be noted that when a wild sub-reel with a different rotational speed or rotational direction is displayed in the same virtual reel strips 72 to 74, players may feel that this type of display is an eyesore because of the need to look at each wild sub-reel.

It should be noted that the wild sub-reels may be rotated in synchronization even among the virtual reel strips 72 to 74. For example, when a wild sub-reel for all of the three virtual reel strips 72 to 74 is displayed in the symbol display region 60, each wild sub-reel in the virtual reel strips 72 to 74 may be rotated in synchronization. In this case, similar to the synchronized rotation of wild sub-reels in the same virtual reel strips 72 to 74, a player may recognize one type of display content without needing to individually recognize content displayed on an entire wild sub-reel because the plurality of wild sub-reels always have the same display content. Therefore, unnecessary eye movements or scattered attention may be reduced during a game, and a player can comfortably enjoy the game.

Second Embodiment

Below, a gaming machine according to Embodiment 2 of the present invention is described with reference to the appended drawings. The gaming machine according to the present embodiment is similar to the gaming machine according to Embodiment 1 wherein a predetermined game value is received from a player, a game result is generated, and a payout corresponding to the game result is provided to the player. Because the main hardware configuration for the gaming machine according to the present embodiment is the same as the gaming machine 1 according to the first embodiment, a description relating to the drawing and hardware configuration are omitted. The configuration of the control unit and the state transitions are also the same, but the application that provides a game is different, and operation in the game providing state is also different. These differences are mainly described below.

Figure 13:
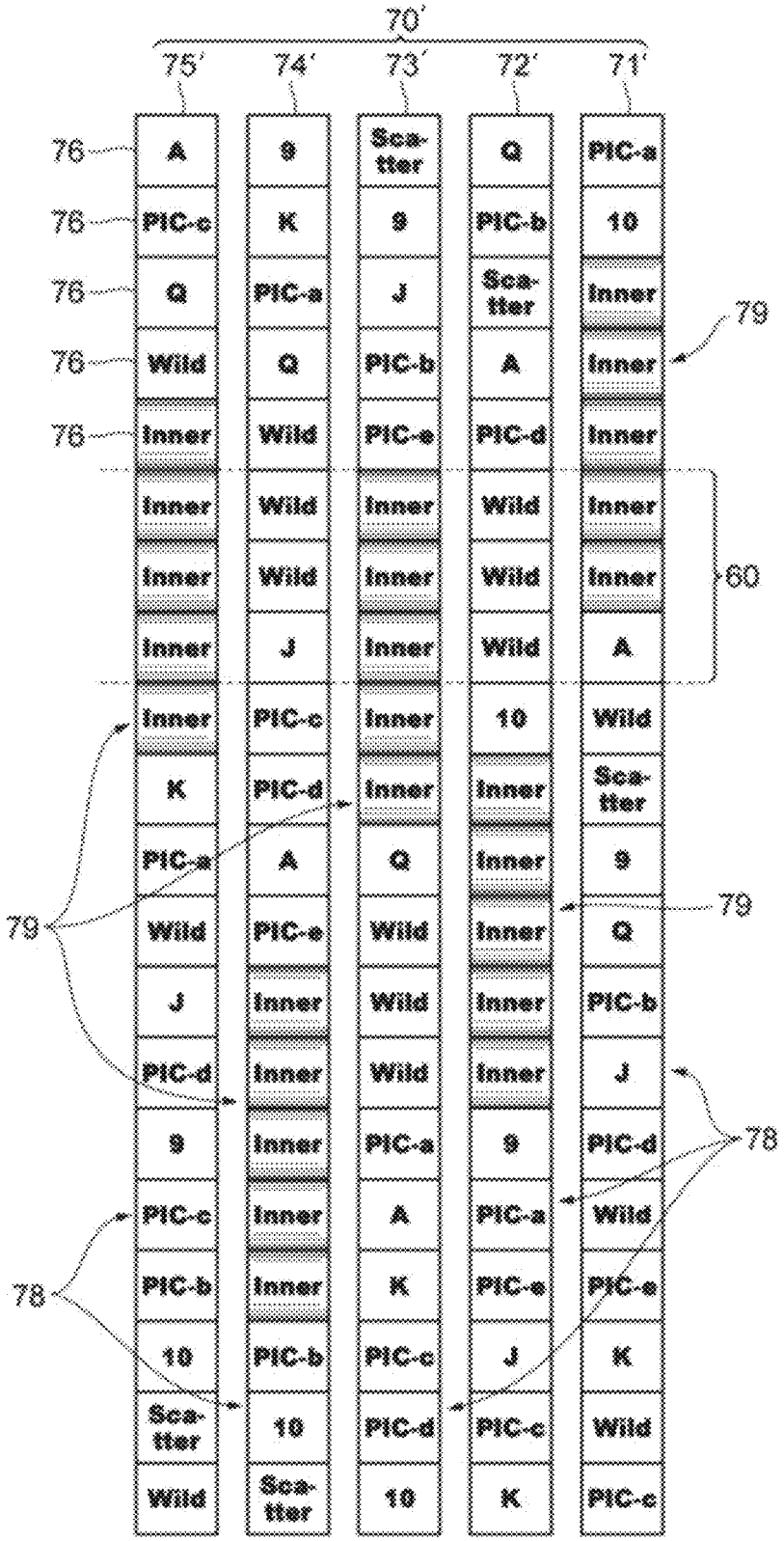
FIG. 13 is a diagram illustrating one example of the reel arrangement displayed in the symbol display region in the gaming machine according to Embodiment 2.

In the present embodiment, the types of reel sequences and symbol sets displayed in the symbol display region 60 are different from Embodiment 1 described above. FIG. 13 is a diagram illustrating one example of reel sequence according to the present embodiment, and FIG. 14 is a diagram illustrating a symbol set according to the present embodiment.

As illustrated in FIG. 13, in Embodiment 2 each virtual reel strip 71' to 75' in a virtual reel set 70' has a group of inner reels (a group of continuous reels composed of five "Inner") as the dynamic symbol region 79, and the dynamic symbol region 79 is configured by five symbol regions 76. In the present embodiment, the inner reels forming the dynamic symbol region 79 display while varying a symbol in the symbol set (second symbol set) illustrated in FIG. 14(*b*) during a normal game, stops varying thereafter, and displays any of the symbols in the second symbol set.

Figure 14A:
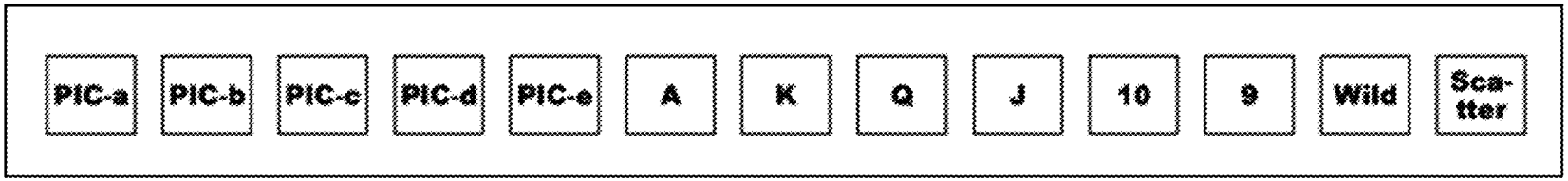
FIGS. 14A and 14B are diagrams illustrating a symbol set of the symbols displayed in the symbol region in the reel in Embodiment 2.
Figure 14B:
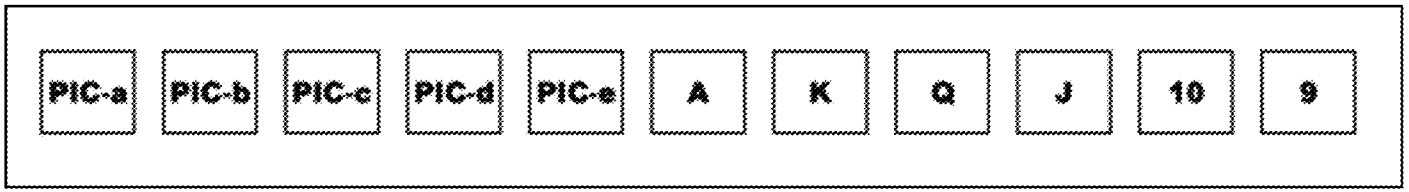

It should be noted that the static symbol region 78, which statically displays a symbol in the present embodiment, is a symbol region 76 except the group of inner reels in the reel sequence illustrated in FIG. 13, which displays the thirteen types of symbols in FIG. 14(*a*).

Figure 15:
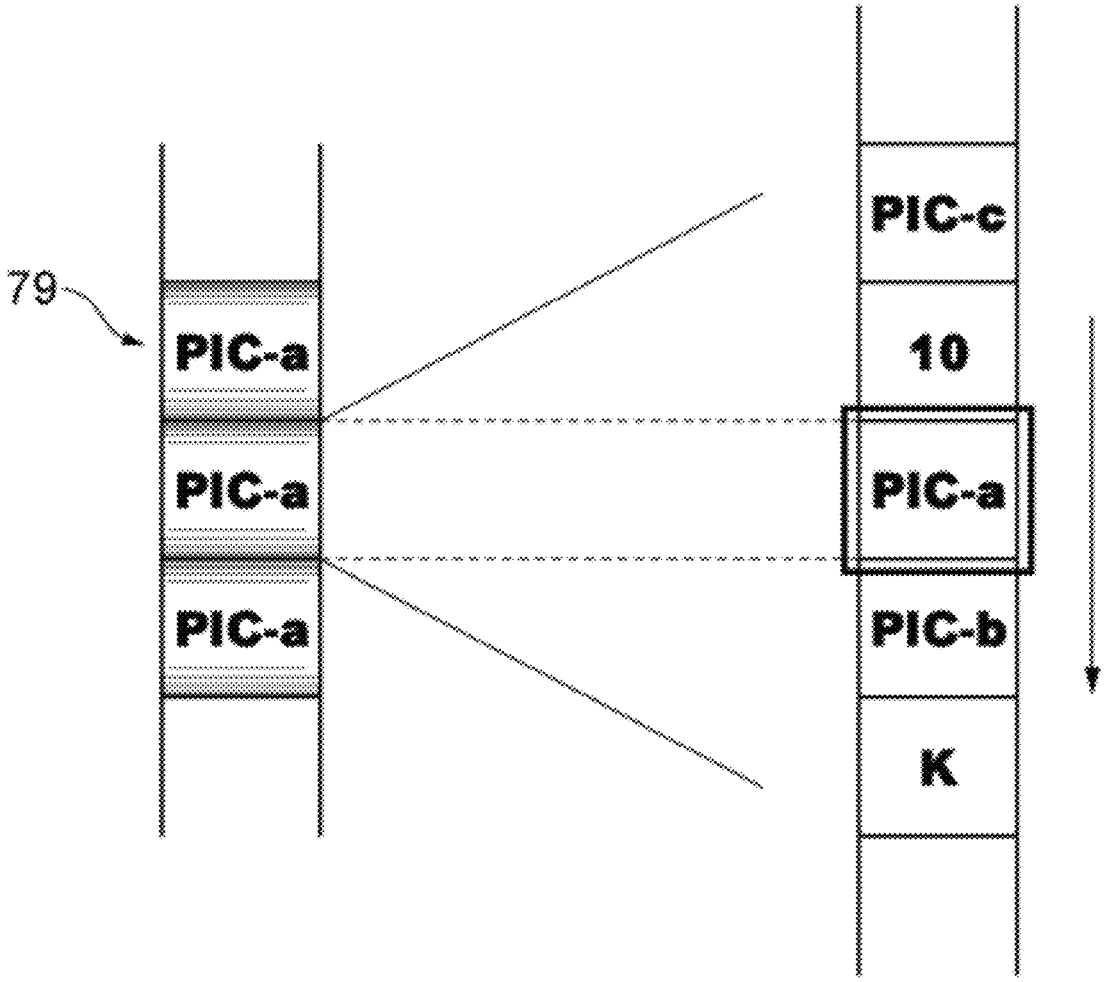
FIG. 15 is a diagram illustrating the display state of an inner reel.
Figure 16A:
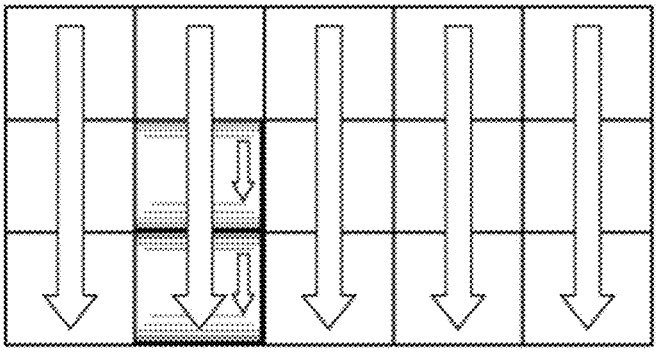
FIGS. 16A, 16B, and 16C are diagrams illustrating a symbol that is rotated and displayed on the inner reel.
Figure 16B:
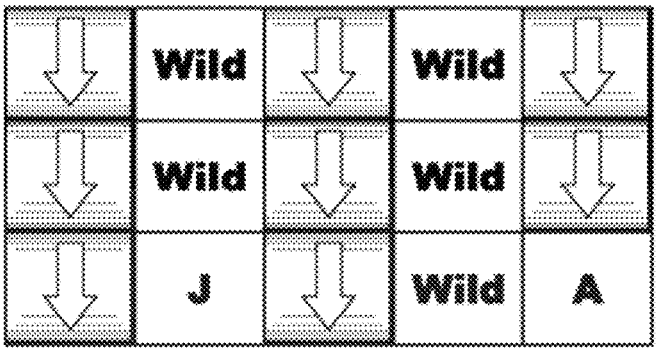
Figure 16C:
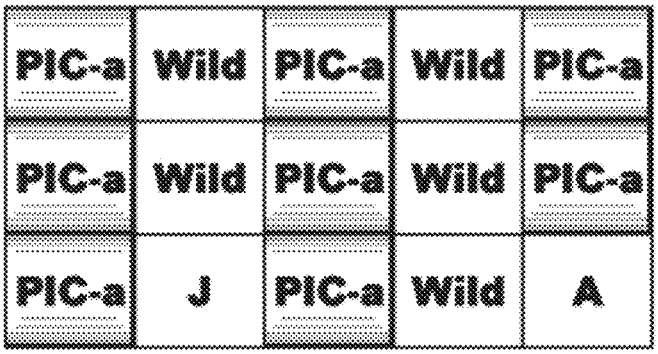

An inner reel forming the dynamic symbol region 79 described above stops the varying and displays any of the symbols in the symbol set illustrated in FIG. 14(*b*), after rotating an inner reel and displaying while varying a symbol in a normal game. Here, one example of an embodiment that rotates an inner reel is described. First, when a normal game starts, along with rotating a virtual reel strip, the control unit 50 also rotates an inner reel, which forms a dynamic symbol region as illustrated in FIG. 16(*a*). At this time, a symbol in an inner reel is varied and displayed according to a symbol sequence in a virtual reel strip configured by the second symbol set as illustrated in FIG. 15. Further, the control unit 50 determines a stopping position for each of the virtual reel strips, and all of the virtual reel strips are stopped and displayed. Even after the virtual reel strips are stopped, rotation of an inner reel displayed in the symbol display region 60 continues as illustrated in FIG. 16(*b*). Further, the control unit 50 determines a stopping position for an inner reel displayed in the symbol display region 60 and all of the inner reels are stopped and displayed. As a result, any of the symbols in the second symbol set are stopped and displayed on an inner reel of the dynamic symbol region 79 as illustrated in FIG. 16(*c*).

It should be noted the determination timing for the stopping position of a virtual reel strip and an inner reel by the control unit 50 is not limited the timing described above. For example, both stopping positions for the virtual reel strip and the inner reel may be determined based on the value of a random number acquired at the starting time of a normal game. Further, even for the timing of the rotation start and the rotation stop of both the virtual reel strip and the inner reel by the control unit 50, the timing is not limited to the above description. For example, the control unit 50 may first rotate and stop only the virtual reel strip, and start rotation of the inner reel thereafter. In this type of embodiment, because symbol varying in the symbol display region 60 is provided in two stages including a stage for the rotation and stop of a virtual reel strip and a stage for the rotation and stop of an inner reel, a process leading to a win is presented to a player in stages which can effectively improve the sense of anticipation and excitement that a player feels. Further, along with rotating the virtual reel strip, the control unit 50 also rotates the inner reel, and may simultaneously stop rotation of the virtual reel strip and rotation of the inner reel in a predetermined timing. In this type of embodiment, because varying of a symbol in the virtual reel strip and the inner reel stops one time, a rhythmical game with a pleasant feel can be provided to a player.

Similar to the wild sub-reel in Embodiment 1, the inner reel is an independent reel that independently rotates and stops and can display while varying a symbol in the symbol region 76 via rotation of the inner reel. Further, each inner reel is stereoscopically displayed as a cylindrical reel extending in the left and right directions (row direction of the symbol display region 60) within the symbol region 76 via three-dimensional computer graphics.

Figure 17:
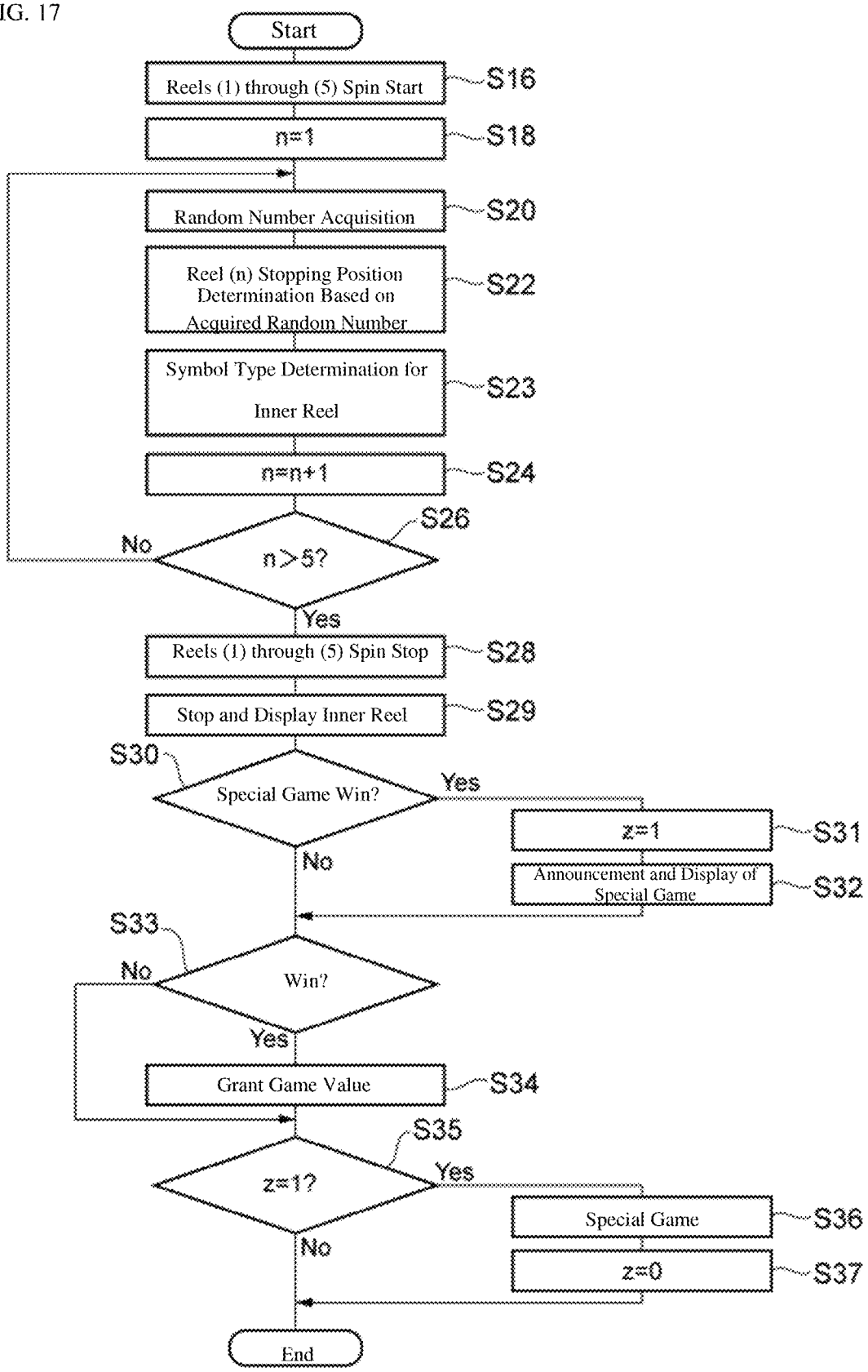
FIG. 17 is a flowchart describing an operation of the gaming machine according to a second embodiment.

Below, as a game control means for the gaming machine 1 according to the second embodiment, operation of the game providing state is described while referencing the flow chart in FIG. 17.

A line number and a bet number are set in the awaiting input state, the gaming machine 1 having transitioned to the game providing state by receiving an operation from the start button starts a normal game by controlling the top display 21 and the bottom display 26 via the control unit 50.

First, a spin of reel (1) through reel (5) being displayed in the symbol display region 60 is started in S16. Further, in S16, simultaneously with the start of the spin of reel (1) through reel (5), the varying and display of each inner real also begins. Subsequently, a parameter of n=1 is set as an initial process by the control unit 50 in the process of S18.

Next, in the process of S20, the control unit 50 acquires a random number, and after acquisition of the random number, the process progresses to S22. In the process of S22, the control unit 50 determines a stopping position for a reel (n) based on the random number acquired in the process of S20. After determination of a stopping position for a reel (n), the process progresses to S23.

In the process of S23, a type of symbol that stops and displays on a group of inner symbols in a reel (n) is determined from within the symbol set illustrated in FIG. 14(*b*). Determination of a symbol type, as one example, can use and determine a random number acquired in the process of S20 and a table. The 11 types of symbols illustrated in FIG. 14(*b*) are not necessarily always determined by a same percentage (that is 1/11), and the table may provide a gradient or bias to the determination ratio of a symbol. In this case, by adjusting a numerical value or the scope of a numerical value associated with each symbol in the table described above, a gradient or bias can be adjusted.

In the process of S24, the control unit 50 is made to be n=n+1. After setting, the process proceeds to S26. In the process of S26, it is determined whether the control unit 50 satisfies n>5. When n>5 is not satisfied, the process proceeds to S20. By this, until n>5 is satisfied, processes S20 to S26 are repeatedly executed. By this, stopping positions for reel (1) through reel (5) are determined. In S26, when n>5 is satisfied, the process proceeds to S28 because a determination of the stopping positions for all of reel (1) through reel (5) is indicated.

In the process of S28, the control unit 50 stops all of reel (1) through reel (5) in order from the left based on the stopping positions of each virtual reel strip 71 to 75, which are determined by the process of S22 (reference FIG. 16(*a*) and FIG. 16(*b*)). More specifically, a symbol column scroll-displayed in the symbol display region 60 is stopped at a stopping position determined for each virtual reel strip 71 to 75. It should be noted that at the moment when the reel (1) through reel (5) stops, an inner reel still continues to rotate as illustrated in FIG. 16(*b*).

In the process of S29, the control unit 50 stops the rotation of an inner reel displayed in the symbol display region 60 (reference FIG. 16(*b*) and (FIG. 16(*c*)).

After the process of S28 and in the process of S30, the control unit 50 determines whether a symbol displayed in the symbol display region 60 satisfies a predetermined condition provided in a special game, similar to S30 in the first embodiment described above. In the symbol display region 60, a winning determination in S30 is determined by a symbol statically displayed in the static symbol region 78 and a symbol stopped and displayed by an inner reel in the dynamic symbol region 79.

Because the processes after S31 in the second embodiment are similar to the processes in the first embodiment, the descriptions are omitted. It should be noted that in a special game in the second embodiment, a general free game may be provided, and a free game using a wild sub-reel as in the first embodiment may be provided based on the winning determination in S30.

According to the gaming machine and the method for providing a game therein according to the second embodiment described above, similar to the gaming machine and method for providing a game therein according to the first embodiment, a game progression rich in variation can be provided to a player via a varied and displayed inner reel, and a wide variety of game results are provided to a player. Therefore, even in the present embodiment, an enthralling game progression can be provided until the end.

It should be noted that in the second embodiment, when a special game is won by a trigger event and while a free game is being executed, the control unit 50 may increase or decrease the number of cells configuring a reel strip in an inner reel. This type of increase or decrease in cell number affects symbol appearance rate in an inner reel. For example, when the number of cells configuring an inner reel is 20, the appearance rate of a symbol in one cell is an average of 5%, but when the number of cells configuring an inner reel is 10, the appearance rate of a symbol in one cell is an average of 10%. That is, the average value of the appearance rate of a symbol becomes smaller as the number of cells configuring an inner reel increases, and the appearance rate of a symbol can be fine-tuned.

Further, when increasing or decreasing the number of cells configuring an inner reel, the types of symbols in an inner reel may also be increased or decreased in conjunction therewith. When a special game is won, the appearance rate for each symbol in an inner reel during a free game can be adjusted by adjusting the number of cells in an inner reel and the types of symbols. As one example, when an inner reel is being configured during a normal game by four cells and four types of symbols, the appearance rate for each type of symbol is an average 25%, but when the number of cells in an inner symbol and the types of symbols are decreased when a special game is won, and when the inner reel is configured by two cells and two symbols during a free game, the average appearance rate for each type of symbol increases to 50%. Meanwhile, when the number of cells in an inner reel and the types of symbols are decreased when a special game is won, and when the inner reel is configured by five cells and five symbols during a free game, the average appearance rate for each type of symbol decreases to 20%. In this way, the probability of winning or the winning payout during a free game can be varied from the probability of winning or the winning payout in a normal game by adjusting the appearance rate for each symbol in an inner reel during a free game.

Further, when a special game is won by a trigger event and while a free game is being executed, the control unit 50 may change or add the types of symbols included in the second symbol set. For example, a portion of the symbols included in the second symbol set can be changed to a wild symbol, and a wild symbol can be added to the second symbol set. In this case, winning becomes easy through the appearance of a wild symbol on an inner reel in a predetermined probability.

Figure 18:
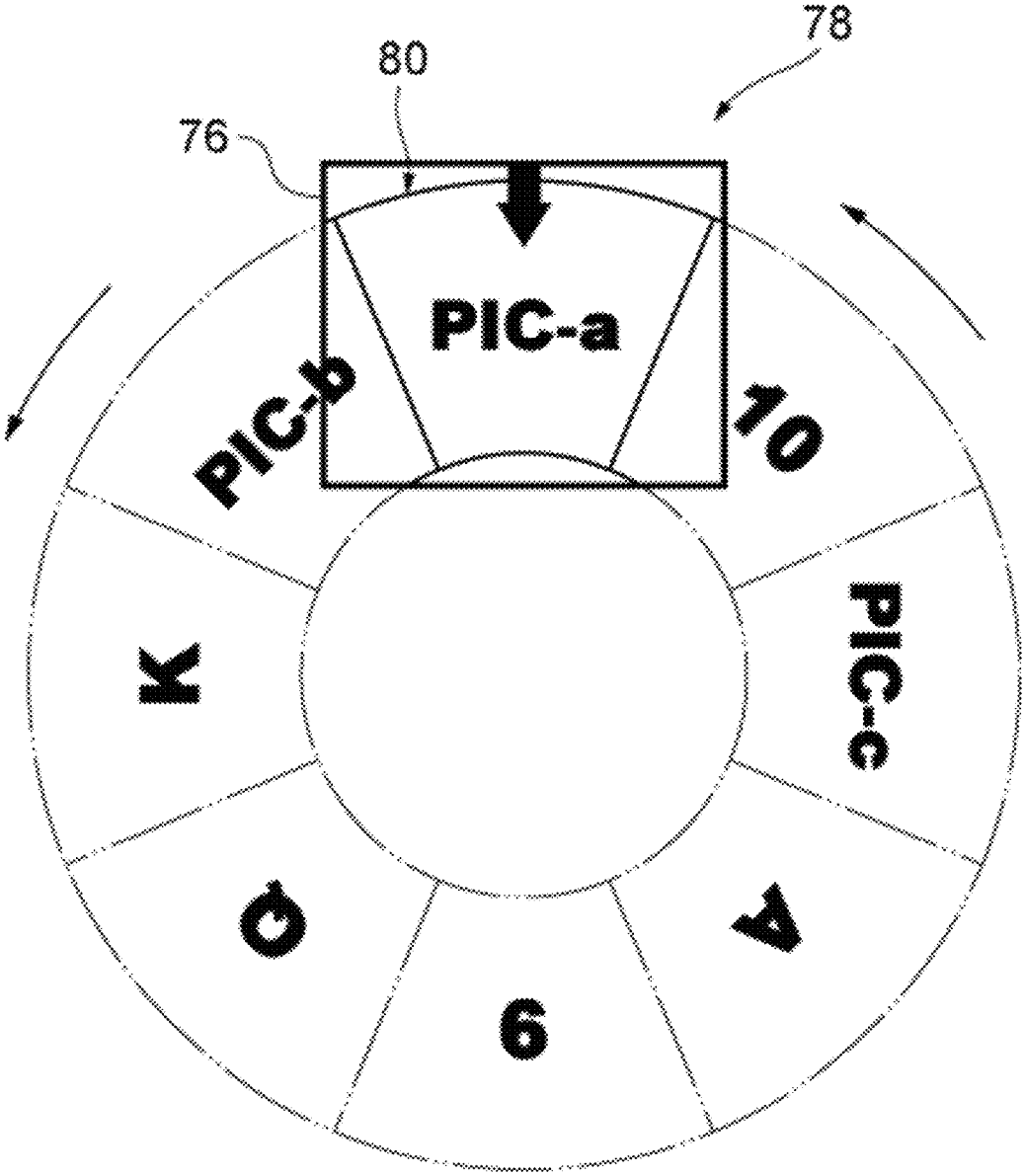
FIG. 18 is a diagram illustrating a modification of the dynamic symbol region.

Further, the dynamic symbol region 79 may be a wheel 80 as illustrated in FIG. 18 in place of the sub-reel described above (that is a wild sub-reel and an inner reel). The wheel 80 includes a plurality of symbols in the second symbol set illustrated in FIG. 14(*b*), and rotates counterclockwise in the dynamic symbol region 79. By this, the symbol indicated by the arrow can be varied by the wheel 80. Even with this type of wheel 80, similar to the sub-reel described above, game results are not evident and cannot be estimated because of the varying of the symbols during the rotation of a reel. Therefore, interest in game results can be sustained until the rotation of an inner reel, which indicates final game results, has stopped.

It should be noted that the function of the control unit 50 in the gaming machine 1 described above may even be achieved via the execution of a program by a computer. That is, development of one or a plurality of computers wherein a program that functions similar to the control unit 50 described above is possible. A function achieved by executing this type of program is the same as the control unit 50 described above, that is according to the acceptance of a player operation by the operation unit 44, a function that stops a symbol displayed in the symbol display region 60 of the bottom display 26, and a function that pays a payout for the combination of symbols formed in the symbol display region 60 of the bottom display 26 are achieved by the combination of a process for rotating a plurality of reels (for example the five reels (1) through (5)) and a process for varying a type of symbol in the dynamic symbol region 79, and by the combination of a function that varies a symbol displayed in the symbol display region 60 in the bottom display 26, a process for stopping varying of the plurality of reels, and a process for stopping the varying of a type of symbol displayed in a dynamic symbol region.

The program described above, for example, can provide recording on a recording medium readable by a computer such as a ROM or a semiconductor memory.

As described above, the gaming machine according to the embodiment of the present invention is provided with an operation unit that receives an operation from a player, a display unit that displays a plurality of reels having a symbol, and a control unit, connected to the recording unit and the display unit, that rotate and stop the plurality of reels according to how a player operates the operation unit and that pays a payout for the combination of symbols formed in the display unit by the stopped plurality of reels, wherein at least one of the plurality of reels has a static symbol display region that statically displays a symbol selected from the first symbol set and a dynamic symbol region that, after displaying while varying the symbols included in a second symbol set, stops the variation and indicates a predetermined symbol, the control unit varies the symbol displayed on the display unit by a combination of a process that rotates the plurality of reels and a process the varies the type of symbol in the dynamic symbol region.

In this type of gaming machine, a reel contains a static symbol region and a dynamic symbol region, and a symbol displayed in a display unit is varied by the combination of a process for rotating a reel, and process for varying a plurality of symbols in the dynamic symbol region. By combining the two processes described above, a game progression rich in variation can be provided to a player, and an even wider variety of game results are provided to a player. Therefore, an enthralling game progression can be provided until the end, and a game having an even higher entertainment value can be provided thereby to a player.

Further, a dynamic symbol region is composed of a plurality of cells that display one symbol each, and the control unit may be a configuration that varies each symbol displayed in the cells. Further, the plurality of cells may be a configuration arranged so as to connect to at least one of the reels. For example, as dynamic symbol region composed of a connected plurality of cells, there is a wild sub-reel that connects the three cells described in the first embodiment, or there is an inner reel, and the like, that connects the five cells described in the second embodiment. By configuring the dynamic symbol regions by connecting cells in this manner, the possibility of a plurality of dynamic symbol regions being displayed on one reel increases, and by varying a symbol in a dynamic symbol region a game progression even more rich in variance can be provided. Further, for a dynamic symbol region where a high payout can be expected (for example a wild sub-reel displayed by a multiplier sub-reel), the expectation of a high payout for a player can be increased due to an increase in the possibility of a plurality of dynamic symbol regions being displayed on one reel. In this case, by further adjusting the number of cells, and the like, various embodiments of a dynamic symbol region can be achieved.

Further, along with displaying a symbol, the control unit displays a sub-reel wherein the reel independently rotates and stops, and may be an embodiment that varies a symbol by rotating the sub-reel. By displaying a dynamic symbol region in an embodiment of a sub-reel, a display embodiment that rotates an accompanying sub-reel in synchronism can be achieved.

Further, the sub-reel described above may be an embodiment that is stereoscopically displayed by three-dimensional computer graphics. In this case, a player can be visually attracted, and a presentation using depth can be performed. It should be noted that in the stereoscopic display of a sub-reel, use of a known stereoscopic representation can be used that shades and changes the shades of color.

Further, along with displaying a symbol, the reel displays a wheel that rotates and stops independently on the cells, and the control unit may be an embodiment that varies a symbol by rotating the wheel.

Further the control unit may be an embodiment that changes the number of cells forming a dynamic symbol region according to the generation of a trigger event. For example, during a free game, and the like, provided as a special game, the number of cells configuring a dynamic symbol region can be changed according to the generation of a trigger event.

Further, the control unit may be an embodiment that varies a dynamic symbol region in synchronization so that a plurality of symbols is displayed on each reel. When a symbol having a different rotation speed and rotation direction is varied without the synchronization of a dynamic symbol region, visibility of a symbol is low and may become an eyesore, but high visibility of a symbol can be obtained and the eyesore eliminated by synchronizing rotation of symbols in a dynamic symbol region.

Further, so that the entire dynamic symbol region, which displays on the display unit, displays the same plurality of symbols, an embodiment that synchronizes and varies the dynamic symbol region is acceptable. In this case, similar to the case that synchronizes varying of a symbol in the dynamic symbol region on each reel, high visibility of a symbol can be obtained without being uncomfortable to look at. Further, by combining the case that synchronizes varying a symbol in the dynamic symbol region on each reel, a further improvement in visibility can be devised. Further, in this case by displaying the same plurality of symbols by the entire dynamic symbol region, expectance of a high payout for a player can be increased.

Further, the control unit may be an embodiment that stops the varying of a symbol in a dynamic symbol region after stopping a plurality of reels. In this case, even if a symbol displayed in the static symbol region 78 is determined by the stopping of a reel, a wide variety of game results are provided to a player, and an enthralling game progression can be provided until the end by a symbol that is stopped by a dynamic symbol region.

Further, the second symbol set may be an embodiment that includes a symbol having a function that grants a predetermined multiplication ratio with regards to each payout. Because this type of symbol (multiplier symbol or multiplier wild symbol) leads to a high payout, a player is provided a sense of expectation for a high payout by displaying on a symbol display region. Therefore, when the symbol is included in a symbol set displayed by a dynamic symbol region, expectation of a high payout can be increased for a player when a dynamic symbol region stops in the symbol display region 60.

Further, the second symbol set may be an embodiment that includes a subset of the first symbol set. For example in a symbol in the first symbol set, a subset composed only of symbols that result in comparatively high payouts can be made into a second symbol set. In this case, because only symbols of a high payout region appear in a dynamic symbol region without the appearance of symbols of a low payout, a symbol stopped in a dynamic symbol region forms a high payout winning combination. By this, a game in an embodiment that generates high payouts can be provided to a player by varying a symbol in the dynamic symbol region. In addition to this type of configuration, an embodiment is possible that greatly varies game results even more by further providing an arrangement that connects cells forming a dynamic symbol, synchronization and varying of a dynamic symbol region on each reel, or synchronization and varying of all of a dynamic symbol region being displayed in a display.

Further, the control unit may also be an embodiment that changes or adds a type of symbol included in the second symbol set according to the generation of a trigger event. The control unit may also be an embodiment that adds a wild symbol to the second symbol set. In this case, a portion of the symbols included in the second symbol set can be changed to wild symbols, and wild symbols can be added to the second symbol set. In this case, the probability of winning increases by the appearance of a wild symbol in a predetermined probability, and a game even more rich in variation can be provided thereby.

The present invention is not limited to the first embodiment and the second embodiment described above, and various modifications are possible. For example, in the embodiments described above, a gaming machine that provides a game via a slot machine is described, but is not limited to this, games of an embodiment such as video card games such as poker, blackjack, and bingo, keno, and wheel games may also be provided. Further, the present invention can also be applied to a pachinko machine or a pachislot machine.

When a dynamic symbol region is a sub-reel, the rotational direction of the sub-reel is not limited to the column direction in the symbol display region 60 (direction parallel to the rotational direction of the reels), the row direction in the symbol display region 60 (direction orthogonal to the rotational direction of the reels) is also possible.

The number of wild sub-reels or inner reels can be appropriately increased or decreased. Further, even the number of reels providing a wild sub-reel or inner reel can be increased or decreased.

Further, in an embodiment described above, an embodiment is described wherein bills or tickets are described as a game value, these are received by the bill/tick identification device, and a ticket is output by a printer unit, but the present invention is not limited to these. The game value is a concept including coins, bills, coins, medals, tangible objects such as tickets, or electronic data having an equivalent value. For example, an embodiment wherein a coin is received by a coin accepter and the coin may be paid from a coin hopper. An embodiment wherein credit accumulated in an account on a server that identifies a player is used, and credit is paid to an account is acceptable, and an embodiment wherein credit information recorded in a storage medium such as a magnetic card or an IC card is read and used, and credit is paid out by writing to the storage medium is also acceptable.

Further, in an embodiment described above, a case that provides a free game as a special game is described, but a normal game may also provide a bonus game using a different virtual reel strip. Further, a feature game provided according to the value of a random number acquired during a normal game can also be provided.

Further, even a predetermined condition providing a special game is not limited to a scatter determination or a line determination, for example when a bet number exceeds a predetermined value, a configuration providing a special game is also acceptable. A configuration that provides a special game according to the value of a random number acquired during a normal game is also possible.

Further, in an embodiment described above, an embodiment that provides a predetermined number of free games as a special game is described, but a special game may be provided without limiting the number of times. In this case, a configuration wherein the combination of specific symbols, establishment of the termination condition of a special game such as the value of a random number acquired during a special game, and the provision of a special game until the termination condition is satisfied is also possible.

DESCRIPTION OF SYMBOLS

1—Gaming Machine
21—Top Display
26—Bottom Display
27—Display Unit
44—Operation Unit
50—Control Unit
51—CPU
60—Symbol Display Region
76—Symbol Region
78—Static Symbol Region

79—Dynamic Symbol Region
70, 70'—Virtual Reel Set
71 to 75, 71' to 75'—Virtual Reel Strip

What is claimed is:

1. A gaming machine, comprising:

an operation unit configured to receive an operation input of a player;

a display unit configured to display a game screen including computer generated graphics;

a memory device storing a game execution program and a data configuration structure, the game execution program including computer instructions for generating a primary game and a special game, the data configuration structure representing a plurality of virtual reels and at least one sub-reel, each virtual reel having a static symbol region including a plurality of static symbols, at least one of the reels having a dynamic symbol region having at least one dynamic symbol location, the at least one sub-reel being associated with the at least one dynamic symbol location; and a game control unit for executing the game execution program to provide the primary game and the special game to the player, the game control unit coupled to the operation unit, the display unit and the memory device, the game control unit including a processor programmed to:

display a game structure on the game screen on the display unit, the game structure including a grid having a plurality cells arranged in a plurality of rows and columns;

initiate the primary game using the plurality of virtual reels and at least one sub-reel including a first number of symbols;

initiate the special game;

change the sub-reel to include a second number of symbols upon detecting a triggering condition, the second number of symbols being different than the first number of symbols;

initiate rotation of each virtual reel, through a respective column of the game structure, at a respective virtual reel start time;

initiate rotation of the sub-reel at a sub-reel start time;

stop rotation of each virtual reel at a respective virtual reel stop time;

stop rotation of the sub-reel at a sub-reel stop time;

wherein the symbols in each cell of the game structure after the virtual reels and the at least one sub-reel have stopped rotation form an outcome of the special game.

2. A gaming machine, as set forth in claim 1, wherein the sub-reel is rotating when rotation of the virtual reels has stopped.

3. A gaming machine, as set forth in claim 1, wherein at least one of the virtual reel start times, virtual reel stop times, sub-reel start time, and sub-reel stop time are randomly determined.

4. A gaming machine, as set forth in claim 1, wherein the rotation of the virtual reels is started and stopped before rotation of the sub-reel starts.

5. A gaming machine, as set forth in claim 1, wherein the virtual reels are rotated in a first direction and the sub-reel is rotated in a second direction.

6. A gaming machine, as set forth in claim 5, wherein the first and second directions are the same.

7. A gaming machine, as set forth in claim 1, wherein the sub-reel is not rotated during the primary game.

8. A gaming machine, as set forth in claim 1, wherein a stopping position of the virtual reels and the sub-reel are determined based on a random event.

9. A control method for a gaming machine, the gaming machine having an operation unit, a display unit, a memory device and a game control unit, the operation unit configured to receive an operation input of a player, the display unit configured to display a game screen including computer generated graphics, the memory device storing a game execution program and a data configuration structure, the game execution program including computer instructions for generating a primary game and a special game, the data configuration structure representing a plurality of virtual reels and at least one sub-reel, each virtual reel having a static symbol region including a plurality of static symbols, at least one of the reels having a dynamic symbol region having at least one dynamic symbol location, the at least one sub-reel being associated with the at least one dynamic symbol location, the game control unit for executing the game execution program to provide the primary game and the special game to the player, the game control unit coupled to the operation unit, the display unit and the memory device, the game control unit including a processor programmed to:

display a game structure on the game screen on the display unit, the game structure including a grid having a plurality cells arranged in a plurality of rows and columns;

initiate the primary game using the plurality of virtual reels and at least one sub-reel including a first number of symbols;

initiate the special game;

change the sub-reel to include a second number of symbols upon detecting a triggering condition, the second number of symbols being different than the first number of symbols;

initiate rotation of each virtual reel, through a respective column of the game structure, at a respective virtual reel start time;

initiate rotation of the sub-reel at a sub-reel start time;

stop rotation of each virtual reel at a respective virtual reel stop time;

stop rotation of the sub-reel at a sub-reel stop time;

wherein the symbols in each cell of the game structure after the virtual reels and the at least one sub-reel have stopped rotation form an outcome of the special game.

10. A control method, as set forth in claim 9, wherein the sub-reel is rotating when rotation of the virtual reels has stopped.

11. A control method, as set forth in claim 9, wherein at least one of the virtual reel start times, virtual reel stop times, sub-reel start time, and sub-reel stop time are randomly determined.

12. A control method, as set forth in claim 9, wherein the rotation of the virtual reels is started and stopped before rotation of the sub-reel starts.

13. A control method, as set forth in claim 9, wherein the virtual reels are rotated in a first direction and the sub-reel is rotated in a second direction.

14. A control method, as set forth in claim 13, wherein the first and second directions are the same.

15. A control method, as set forth in claim 9, wherein the sub-reel is not rotated during the primary game.

16. A control method, as set forth in claim 9, wherein a stopping position of the virtual reels and the sub-reel are determined based on a random event.

17. One or more non-transitory computer-readable storage media, having computer-executable instructions embodied thereon, wherein when executed by a processor, the computer-executable instructions cause the processor to:

receive an operation input of a player on an operation unit;

display, on a display unit, a game screen including computer generated graphics;

store, on a memory device a game execution program and a data configuration structure, the game execution program including computer instructions for generating a primary game and a special game, the data configuration structure representing a plurality of virtual reels and at least one sub-reel, each virtual reel having a static symbol region including a plurality of static symbols, at least one of the reels having a dynamic symbol region having at least one dynamic symbol location, the at least one sub-reel being associated with the at least one dynamic symbol location, display a game structure on a game screen on a display unit, the game structure including a grid having a plurality cells arranged in a plurality of rows and columns;

initiate the primary game using the plurality of virtual reels and at least one sub-reel including a first number of symbols;

initiate the special game;

change the sub-reel to include a second number of symbols upon detecting a triggering condition, the second number of symbols being different than the first number of symbols;

initiate rotation of each virtual reel, through a respective column of the game structure, at a respective virtual reel start time;

initiate rotation of the sub-reel at a sub-reel start time;

stop rotation of each virtual reel at a respective virtual reel stop time;

stop rotation of the sub-reel at a sub-reel stop time;

wherein the symbols in each cell of the game structure after the virtual reels and the at least one sub-reel have stopped rotation form an outcome of the special game.

18. One or more non-transitory computer-readable storage media, as set forth in claim 17, wherein the sub-reel is rotating when rotation of the virtual reels has stopped.

19. One or more non-transitory computer-readable storage media, as set forth in claim 17, wherein at least one of the virtual reel start times, virtual reel stop times, sub-reel start time, and sub-reel stop time are randomly determined.

20. One or more non-transitory computer-readable storage media, as set forth in claim 17, wherein the rotation of the virtual reels is started and stopped before rotation of the sub-reel starts.

21. One or more non-transitory computer-readable storage media, as set forth in claim 17, wherein the virtual reels are rotated in a first direction and the sub-reel is rotated in a second direction.

22. One or more non-transitory computer-readable storage media, as set forth in claim 21, wherein the first and second directions are the same.

23. One or more non-transitory computer-readable storage media, as set forth in claim 17, wherein the sub-reel is not rotated during the primary game.

24. One or more non-transitory computer-readable storage media, as set forth in claim 17, wherein a stopping position of the virtual reels and the sub-reel are determined based on a random event.

* * * * *